US007147981B2

(12) United States Patent
Fujikawa et al.

(10) Patent No.: US 7,147,981 B2
(45) Date of Patent: Dec. 12, 2006

(54) TONER

(75) Inventors: Hiroyuki Fujikawa, Kanagawa (JP); Masami Fujimoto, Shizuoka (JP); Takakuni Kobori, Shizuoka (JP); Masaaki Taya, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 305 days.

(21) Appl. No.: 10/809,458

(22) Filed: Mar. 26, 2004

(65) Prior Publication Data

US 2004/0259012 A1 Dec. 23, 2004

(30) Foreign Application Priority Data

Mar. 27, 2003 (JP) ..... 2003-086714

(51) Int. Cl.
*G03G 9/087* (2006.01)

(52) U.S. Cl. ..... 430/109.2; 430/109.3

(58) Field of Classification Search ..... 430/109.2, 430/109.3

See application file for complete search history.

(56) References Cited

U.S. PATENT DOCUMENTS

| | | | | |
|---|---|---|---|---|
| 2,297,691 | A | 10/1942 | Carlson | |
| 5,262,265 | A | 11/1993 | Matsunaga et al. | 430/109 |
| 5,370,958 | A | 12/1994 | Shin et al. | 430/110 |
| 5,466,553 | A | 11/1995 | Okutani et al. | 430/109 |
| 5,518,848 | A | 5/1996 | Ito et al. | 430/96 |
| 5,571,653 | A | 11/1996 | Kasuya et al. | 430/109 |
| 6,235,441 | B1 | 5/2001 | Tanikawa et al. | 430/106 |
| 6,497,983 | B1 | 12/2002 | Iwa et al. | 430/109.2 |
| 6,670,087 | B1 | 12/2003 | Fujikawa et al. | 430/109.2 |
| 2002/0076637 | A1 | 6/2002 | Iwa et al. | 430/109.2 |
| 2002/0098431 | A1 | 7/2002 | Fujikawa et al. | 430/106.2 |

FOREIGN PATENT DOCUMENTS

| | | |
|---|---|---|
| EP | 0651292 | 5/1995 |
| EP | 1011032 | 6/2000 |
| EP | 1197805 | 4/2002 |
| JP | 42-23910 | 11/1967 |
| JP | 43-24748 | 10/1968 |
| JP | 55-90509 | 7/1980 |
| JP | 57-178249 | 11/1982 |
| JP | 57-178250 | 11/1982 |
| JP | 60-4946 | 1/1985 |
| JP | 61-110155 | 5/1986 |
| JP | 61-110156 | 5/1986 |
| JP | 62-9256 | 1/1987 |
| JP | 62-194260 | 8/1987 |

(Continued)

*Primary Examiner*—Mark A. Chapman
(74) *Attorney, Agent, or Firm*—Fitzpatrick, Cella, Harper & Scinto

(57) ABSTRACT

In a toner having toner particles having at least a binder resin and a colorant, the binder resin in the toner contains at least i) a vinyl resin formed of a vinyl resin having at least a carboxyl group and a vinyl resin having at least an epoxy group, and having a cross-linked structure formed by the reaction of the carboxyl group of the former with the epoxy group of the latter, and ii) a copolymer having an aliphatic conjugated diene compound as a monomer component; and the binder resin in the toner has a THF-insoluble matter in a content of from 0.1% by weight to 60% by weight, and the copolymer having an aliphatic conjugated diene compound as a monomer component is incorporated in an o-dichlorobenzene-soluble matter of the THF-insoluble matter. This toner has superior developing stability and running performance in high-speed machines, and can keep fixing separation claws from contamination.

10 Claims, 1 Drawing Sheet

FOREIGN PATENT DOCUMENTS

| | | |
|---|---|---|
| JP | 63-214760 | 4/1988 |
| JP | 63-217362 | 9/1988 |
| JP | 63-217363 | 9/1988 |
| JP | 63-217364 | 9/1988 |
| JP | 2-168264 | 6/1990 |
| JP | 2-235069 | 9/1990 |
| JP | 3-63661 | 3/1991 |
| JP | 3-63662 | 3/1991 |
| JP | 3-63663 | 3/1991 |
| JP | 3-118552 | 5/1991 |
| JP | 5-17363 | 7/1993 |
| JP | 5-173366 | 7/1993 |
| JP | 5-241371 | 9/1993 |
| JP | 6-11890 | 1/1994 |
| JP | 6-222612 | 8/1994 |
| JP | 7-20654 | 1/1995 |
| JP | 7-225491 | 8/1995 |
| JP | 8-44107 | 2/1996 |
| JP | 9-185182 | 7/1997 |
| JP | 9-244295 | 9/1997 |
| JP | 9-319410 | 12/1997 |
| JP | 10/87837 | 4/1998 |
| JP | 10-90943 | 4/1998 |

FIGURE
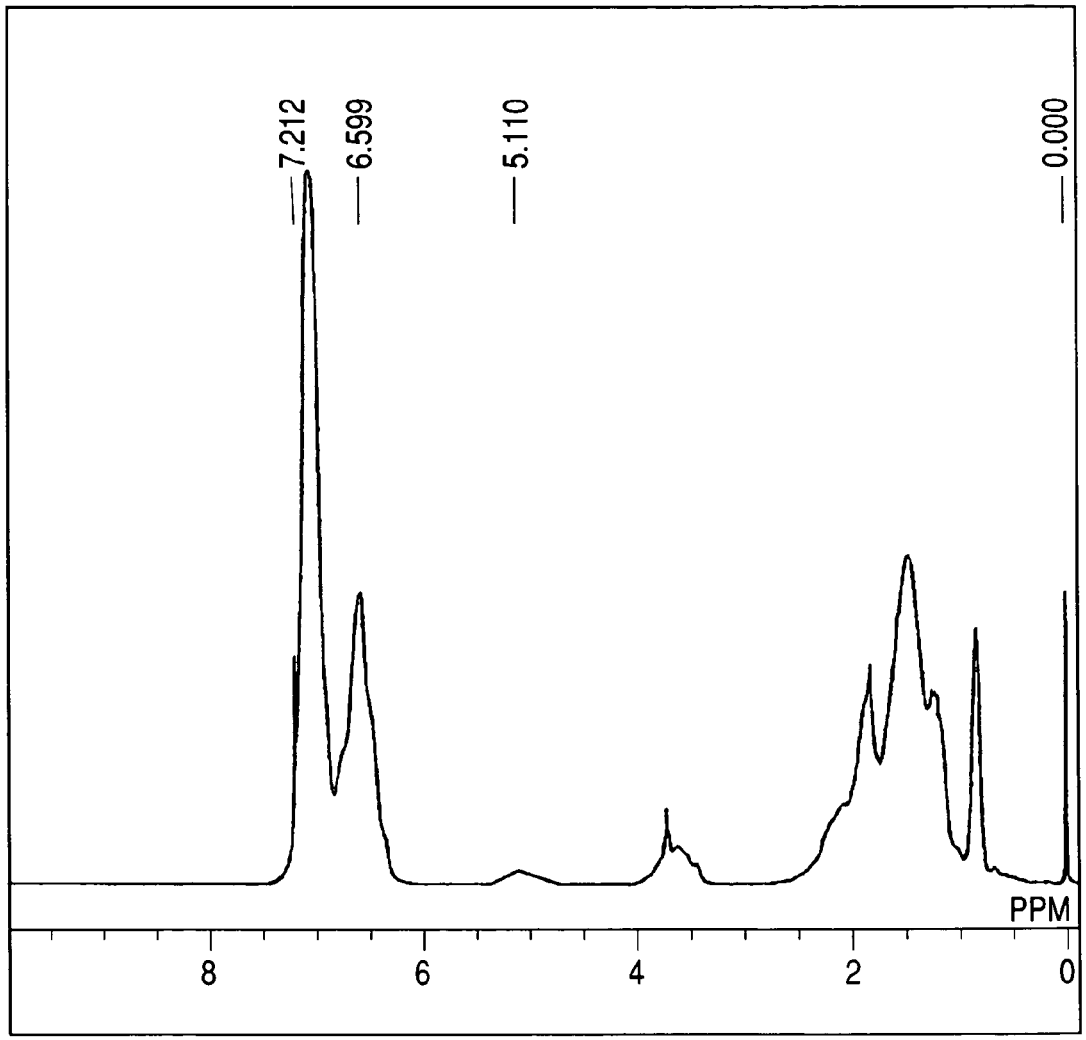

TONER

BACKGROUND OF THE INVENTION

1. Field of the Invention

This invention relates to a toner used in recording processes such as electrophotography, electrostatic recording, magnetic recording and toner jet recording.

2. Related Background Art

A number of methods as disclosed in U.S. Pat. No. 2,297,691, Japanese Patent Publication Nos. S42-23910 and S43-24748 and so forth are conventionally known as methods for electrophotography. In general, copies are obtained by forming an electric latent image (electrostatic latent image) on a photosensitive member by various means utilizing a photoconductive material, subsequently developing the latent image by the use of a toner to form a toner image, and transferring the toner image to a transfer medium (recording medium) such as paper as occasion calls, followed by fixing by the action of heat, pressure, heat-and-pressure, or solvent vapor. The toner that has not transferred and has remained on the photosensitive member is cleaned by various means, and then the above process is repeated.

In recent years, as a reflection of changing commercial needs for making composite, personal and so forth, such copying machines are severely sought to be made more small-sized, more light-weight, more high-speed and more highly reliable. As the result, performances required for toners have also become high-level.

In particular, one-component development making use of magnetic toners is preferably used because of its developing assembly having a simple structure, which may cause less troubles, has a long lifetime and may require only easy maintenance service.

Still in recent years, image-forming apparatus employing an electrophotographic technique, such as copying machines and laser beam printers, have been made to have various functions, and toner images to be formed are sought to be of high precision and high image quality. Accordingly, used are toners suited therefor and process cartridges making use of such toners.

For example, Japanese Patent Publication No. S51-23354 discloses a toner comprising a vinyl polymer cross-linked to an appropriate degree by adding a cross-linking agent and a molecular weight modifier. Also proposed are toners of a blend type comprising a vinyl polymer in which its glass transition temperature (Tg), molecular weight and gel content are specified in combination.

Such toners containing a cross-linked vinyl polymer or a gel content have an excellent effect on anti-offset properties. However, where such a cross-linked vinyl polymer is used in order to incorporate it in a toner, the polymer may have a very great internal friction in the step of melt kneading when the toner is produced, and a large shear force is applied to the polymer. Hence, in many cases, the cutting of molecular chains occurs to cause a decrease in melt viscosity, and this may adversely affect the anti-offset properties.

Accordingly, to solve this problem, it is proposed, as disclosed in, e.g., Japanese Patent Application Laid-Open Nos. S55-90509, S57-178249, S57-178250 and S60-4946, that, a resin having a carboxylic acid and a metal compound are used as toner materials and are heated and reacted at the time of melt-kneading to form a cross-linked polymer, which is then incorporated into the toner.

Japanese Patent Application Laid-Open Nos. S61-110155 and S61-110156 also disclose that a binder resin having as essential constituent units a vinyl monomer and also a special monoester compound is allowed to react with a polyvalent metal compound to carry out cross-linking through the metal.

Japanese Patent Application Laid-Open Nos. S63-214760, S63-217362, S63-217363 and S63-217364 still also disclose that a binder resin has a molecular weight distribution separated into two groups, a low-molecular weight resin component and a high-molecular weight resin component, and carboxylic acid groups incorporated into the low-molecular weight resin component are allowed to react with polyvalent metal ions to carry out cross-linking (a dispersion of a metal compound is added to a solution obtained by solution polymerization, followed by heating to carry out the reaction).

Japanese Patent Application Laid-Open Nos. H2-168264, H2-235069, H5-173363, H5-173366 and H5-241371 still also disclose toner binder compositions and toners in which the molecular weights, mixing ratios, acid values and their percentages of a low-molecular weight resin component and a high-molecular weight resin component in a binder resin are controlled to improve fixing performance and anti-offset properties.

Japanese Patent Application Laid-Open No. S62-9256 still also discloses a toner binder resin composition comprising a blend of two kinds of vinyl resins having different molecular weights and resin acid values.

Japanese Patent Application Laid-Open Nos. H3-63661, H3-63662, H3-63663 and H3-118552 still also discloses that a carboxyl-group-containing vinyl copolymer and an epoxy-group-containing vinyl copolymer are allowed to react with a metal compound to carry out cross-linking.

Japanese Patent Application Laid-Open Nos. H7-225491 and H8-44107 still also disclose that a carboxyl-group-containing resin reacts with an epoxy resin to form a cross-linked structure.

Japanese Patent Application Laid-Open Nos. S62-194260, H6-11890, H6-222612, H7-20654, H9-185182, H9-244295, H9-319410, H10-87837 and H10-90943 still also disclose toner binder resin compositions and toners in which molecular weight distribution, gel content, acid value, epoxy value and so forth are controlled in a resin composition constituted of a carboxyl-group-containing resin, using a glycidyl-group-containing resin as a cross-linking agent, to improve fixing performance and anti-offset properties.

These proposals disclosed as shown above, though having merits and demerits, have in fact attained good effects in respect of the improvement in anti-offset properties. There, however, are problems on developing stability and running performance when applied to magnetic toners for one-component development. Thus, a further improvement is required.

SUMMARY OF THE INVENTION

An object of the present invention is to solve the above problems to provide a toner having superior developing stability and running performance in high-speed machines.

Another object of the present invention is to provide a toner having superior low-temperature fixing performance and anti-offset properties.

Still another object of the present invention is to provide a toner having superior contamination-preventive properties to fixing separation claws.

That is, the present invention provides a toner comprising toner particles having at least a binder resin and a colorant, wherein;

the binder resin in the toner contains at least i) a vinyl resin formed of a vinyl resin having at least a carboxyl group and a vinyl resin having at least an epoxy group, and having a cross-linked structure formed by the reaction of the carboxyl group of the former with the epoxy group of the latter, and ii) a copolymer having an aliphatic conjugated diene compound as a monomer component; and the binder resin in the toner has a THF-insoluble matter in a content of from 0.1% by weight to 60% by weight, and the copolymer having an aliphatic conjugated diene compound as a monomer component is incorporated in an o-dichlorobenzene-soluble matter of the THF-insoluble matter.

BRIEF DESCRIPTION OF THE DRAWING

FIGURE is a measurement chart obtained by $^{1}$H-NMR measurement of the THF-insoluble matter in the resin component of a toner in Example 1 of the present invention.

DESCRIPTION OF THE PREFERRED EMBODIMENTS

The present inventors have discovered that, in a toner containing at least a binder resin and a colorant, the binder resin may contain at least i) a vinyl resin formed of a vinyl resin having at least a carboxyl group and a vinyl resin having at least an epoxy group, and having a cross-linked structure formed by the reaction of the carboxyl group of the former with the epoxy group of the latter and ii) a copolymer having an aliphatic conjugated diene compound as a monomer component, whereby superior developing stability and running performance can be brought out in high-speed machines. Such a toner also has superior low-temperature fixing performance and anti-offset properties and brings out the function to excel in contamination-preventive properties to fixing separation claws.

In the present invention, the binder resin in the toner further contains a tetrahydrofuran(THF)-insoluble matter in a specific quantity, and the copolymer having an aliphatic conjugated diene compound as a monomer component is incorporated in the THF-insoluble matter. This further enhances the above effect.

The toner of the present invention is a toner in which a cross-linked structure has been formed upon reaction of carboxyl groups with epoxy groups when materials are heat melt-kneaded in the step of kneading or the like in a toner production process. In that reaction, a copolymer having an aliphatic conjugated diene compound as a monomer unit (hereinafter "aliphatic conjugated diene copolymer") is made present together under the cross-linking reaction of the carboxyl group unit with the epoxy group unit in the binder resin. This can enhance toughness of the resultant cross-linked body to make the toner itself tough. That is, the aliphatic conjugated diene copolymer can be enclosed in the network structure of the cross-linked body formed as a result of the above cross-linking reaction, and hence a cross-linked body having a larger extent of spatial volume and having impact resilience is formed, as so presumed.

Thus, since in the present invention the cross-linked body having a larger extent of spatial volume and having impact resilience can be formed, the toughness of the resultant cross-linked body can be enhanced to make the toner itself tough, so that the cutting of molecular chains can be kept from occurring at the time of kneading. Also, where the toner is used in high-speed machines or the like, superior developing stability and running performance can be achieved even when copies are taken in a large volume.

The toner of the present invention may also preferably have a THF-insoluble matter in a content of from 0.1 to 60% by weight as a result of the above cross-linking reaction, more preferably from 5 to 50% by weight, and particularly preferably from 10 to 45% by weight. In the case when the THF-insoluble matter is within this range, better low-temperature fixing performance, anti-offset properties and contamination-preventive properties to fixing separation claws can be achieved.

In addition, in the THF-insoluble matter of the resin component in the toner of the present invention, at least the aliphatic conjugated diene copolymer may preferably be incorporated in the o-dichlorobenzene-soluble matter in the THF-insoluble matter. This means that the aliphatic conjugated diene copolymer is enclosed in the network structure of the resultant cross-linked body. In virtue of this feature, the cross-linked component being formed can be kept to have extensibility and relaxation properties, the cutting of molecular chains can be kept from occurring at the time of kneading, and the above effect can further be enhanced.

As the reason why the cross-linked component contained in the toner of the present invention has solubility in o-dichlorobenzene, it is presumed as follows: The cross-linked component has a spatially large molecular structure. Since, however, the aliphatic conjugated diene copolymer is enclosed therein, the product has a lower apparent density than in the prior art cross-linking that makes use of divinylbenzene or a metal compound, and also since a cross-linked component having in the cross-linked structure the same benzene ring structure as the o-dichlorobenzene, the compatibility is enhanced and brought out.

The presence of the aliphatic conjugated diene copolymer contained in the THF-insoluble matter can be confirmed by making nuclear magnetic resonance (NMR) measurement using a soluble measuring solvent (o-dichlorobenzene d4, a heavy hydride). More specifically, signals due to protons bonding to unsaturated-bond moieties of a diene compound are detected in the vicinity of 5.1 ppm by $^{1}$H-NMR measurement of the THF-insoluble matter. By comparing the integral ratio of these signals with the integral ratio of signals of other monomer components, the molar component ratio to other monomer components in the o-dichlorobenzene-soluble matter can be calculated.

In the THF-insoluble matter, the aliphatic conjugated diene copolymer may also preferably be in a content of from 10 to 60% by weight. Incorporation of the aliphatic conjugated diene copolymer in the THF-insoluble matter within this range makes the effect of the present invention more remarkable.

The toner of the present invention may preferably have an acid value of from 0.1 to 50 mg·KOH/g, more preferably from 0.5 to 50 mg·KOH/g, and particularly preferably from 0.5 to 40 mg·KOH/g. Since the toner of the present invention has the desired acid value, good developing stability, running performance, low-temperature fixing performance, anti-offset properties, and contamination-preventive properties to fixing separation claws can be achieved.

If the toner has an acid value of less than 0.1 mg·KOH/g, it means that the carboxyl groups are not sufficiently present, and this may make it difficult to form the cross-linked body, resulting in low anti-offset properties. Even if the reaction time is elongated to make the cross-linked body formed, the cross-linked body may have large distances between cross-link points, making it difficult to bring out the above effect, and also resulting in low contamination-preventive properties to fixing members. If on the other hand it has an acid value of more than 50 mg·KOH/g, toner particles may have so strong a negative chargeability as to result in a low developing performance when applied in positively chargeable toners.

In the present invention, in molecular weight distribution measured by gel permeation chromatography (GPC) of THF-soluble matter in the toner, the toner may preferably have a number-average molecular weight (Mn) of from 1,000 to 40,000, more preferably from 2,000 to 20,000, and particularly preferably from 3,000 to 15,000, and may preferably have a weight-average molecular weight (Mw) of from 10,000 to 10,000,000, more preferably from 20,000 to 5,000,000, and particularly preferably from 30,000 to 1,000,000.

In the case when the toner used in the present invention has the above average molecular weights in a chromatogram of GPC of its THF-soluble matter, the toner can retain proper charge quantity and toughness, so that good developing stability, running performance, low-temperature fixing performance and anti-offset properties can be achieved.

If in the above molecular weight distribution the toner has a number-average molecular weight of less than 1,000 or a weight-average molecular weight of less than 10,000, the toner may have so low a melt viscosity that other materials may poorly be dispersed in toner particles to provide non-uniform charge distribution and make it difficult to control fog, resulting in low developing performance, running performance and anti-offset properties. If the toner has a number-average molecular weight of more than 40,000 or a weight-average molecular weight of more than 10,000,000, a high-molecular weight resin component and a low-molecular weight resin component in the binder resin may have a low compatibility with each other, so that the binder resin itself may have non-uniform component distribution, resulting in a low dispersibility of other materials, and resulting in low developing performance, running performance and fixing performance.

In the present invention, in molecular weight distribution measured by GPC of THF-soluble matter in the toner, the toner may also preferably have a main peak (Mp) in the region of molecular weight of from 4,000 to 30,000, and may more preferably have a main peak in the region of molecular weight of from 5,000 to 20,000.

If the toner has a main peak in the region of molecular weight of less than 4,000, the toner may have so low a melt viscosity that other materials may poorly be dispersed in toner particles to provide non-uniform charge distribution, resulting in a non-uniform charge distribution to make fog low controllable, and resulting in low developing performance, running performance and anti-offset properties. If on the other hand it has a main peak in the region of molecular weight of more than 30,000, the toner may have a low fixing performance.

In the chart obtained by GPC measurement, the peak area in the region of molecular weight of 30,000 or less may preferably be in a proportion of from 60% to 100% with respect to the total peak area. In the case when the peak area in the region of molecular weight of 30,000 or less is within the above range, other materials can well be dispersed in toner particles. If it is less than 60%, the resin may have so high a melt viscosity that the materials may poorly be dispersed in toner particles, resulting in low developing performance, running performance and fixing performance.

The toner of the present invention may preferably have a glass transition point (Tg) of from 50° C. to 70° C. If it has a Tg of less than 50° C., it may have a poor storage stability. If it has a Tg of more than 70° C., it may have a poor fixing performance.

In the present invention, as the resin used when the toner is produced, it is preferable to use a vinyl resin of any of:

i) a vinyl resin having a carboxyl group and a vinyl resin having an epoxy group; and ii) a vinyl resin having a carboxyl group and an epoxy group.

The toner is produced through the step of melt-kneading, using such a vinyl resin together with other components such such as the aliphatic conjugated diene compound, whereby the toner can be obtained in which carboxyl groups and epoxy groups have been reacted with each other to introduce the cross-linked structure into the binder resin of the toner and also the aliphatic conjugated diene copolymer is contained in the THF-insoluble matter.

As the resin used when the toner is produced, it is also preferable to use a vinyl resin formed of a vinyl resin having a carboxyl group and a vinyl resin having an epoxy group the carboxyl group and epoxy group of which have previously been reacted with each other. In the case when such a vinyl resin is used, all carboxyl groups and epoxy groups are not previously reacted, but some of them are made to remain unreacted, whereby the aliphatic conjugated diene copolymer can be taken in the cross-linked structure in such a way that the aliphatic conjugated diene copolymer is incorporated in the THF-insoluble matter when the vinyl resin is melt-kneaded together with other components such as the aliphatic conjugated diene compound.

As a monomer having a carboxyl group that constitutes the vinyl resin having a carboxyl group, it may include, e.g., acrylic acids such as acrylic acid, methacrylic acid, α-ethylacrylic acid, crotonic acid, cinnamic acid, vinylacetic acid, isocrotonic acid, tiglic acid and angelic acid, and anhydrides or α- or β-alkyl derivatives of these; and unsaturated dicarboxylic acids such as fumaric acid, maleic acid, citraconic acid, alkenylsuccinic acids, itaconic acid, mesaconic acid, dimethylmaleic acid and dimethylfumaric acid, and monoester derivatives, anhydrides or α- or β-alkyl derivatives of these.

As the vinyl resin having a carboxyl group, it may be a vinyl resin obtained by polymerizing alone such a monomer having a carboxyl group, or may be a vinyl resin obtained by mixing the monomer with other vinyl monomer to effect copolymerization by a known polymerization method.

The vinyl resin having a carboxyl group may preferably have an acid value of from 0.5 to 60 mg·KOH/g in order to achieve good fixing performance and anti-offset properties. If it has an acid value of less than 0.5 mg·KOH/g, the sites at which the carboxyl group and the epoxy group undergo cross-linking reaction are so few that the vinyl resin has only few cross-linking components to make it difficult for the toner to exhibit its running performance. In such a case, however, a vinyl resin having an epoxy group with a high epoxy value may be used to make compensation to a certain extent. If the vinyl resin having a carboxyl group has an acid value of more than 60 mg·KOH/g, the binder resin in toner particles may have so strong a negative chargeability as to tend to result in a decrease in image density and an increase in fog when applied in positively chargeable toners.

The vinyl resin having a carboxyl group may preferably have a glass transition point (Tg) of from 40° C. to 70° C. If it has a Tg of less than 40° C., the toner tends to have low anti-blocking properties. If it has a Tg of more than 70° C., the toner tends to have a low fixing performance.

In the vinyl resin having a carboxyl group, its number-average molecular weight in molecular weight distribution measured by GPC of THF-soluble matter may preferably be from 1,000 to 40,000 in order to achieve good fixing performance and developing performance, and its weight-average molecular weight may preferably be from 10,000 to 10,000,000 in order to achieve good anti-offset properties, anti-blocking properties and running performance.

The vinyl resin having a carboxyl group may preferably contain a low-molecular weight resin component and a high-molecular weight resin component. The low-molecular weight resin component may preferably have a peak molecular weight ($Mp_L$) of from 4,000 to 30,000 in order to achieve good fixing performance. The high-molecular weight resin component may preferably have a peak molecular weight ($Mp_H$) of from 100,000 to 1,000,000 in order to achieve good anti-offset properties, anti-blocking properties and running performance.

Polymerization methods that may be used in the present invention as methods for synthesizing the high-molecular weight resin component may include bulk polymerization, solution polymerization, emulsion polymerization and suspension polymerization.

Of these, the emulsion polymerization is a method in which a monomer almost insoluble in water is dispersed with an emulsifying agent in an aqueous phase in the form of small particles to carry out polymerization using a water-soluble polymerization initiator. This method enables easy control of reaction heat, and requires only a small rate of termination reaction since the phase where the polymerization is carried out (an oily phase formed of polymers and monomers) is separate from the aqueous phase, so that a product with a high polymerization concentration and a high degree of polymerization can be obtained. Moreover, since the polymerization process is relatively simple and the polymerization product is in the form of fine particles, colorants, charge control agents and other additives can be mixed with ease when the toner is produced. Thus, this has an advantage as a production process for binder resins for toners.

However, the polymer tends to become impure because of the emulsifying agent added, and an operation such as salting-out is required to take out the polymer. In order to avoid such difficulties, solution polymerization and suspension polymerization are advantageous.

In the solution polymerization, as the solvent used, xylene, toluene, cumene, cellosolve acetate, isopropyl alcohol or benzene may be used. Where styrene monomers are used, xylene, toluene or cumene is preferred. The solvent may appropriately be selected depending on the polymer to be produced by polymerization. As to reaction temperature, which may differ depending on the solvent and polymerization initiator to be used and the polymer to be produced by polymerization, the reaction may be carried out usually at 70° C. to 230° C. In the solution polymerization, the monomer may preferably be used in an amount of from 30 to 400 parts by weight based on 100 parts by weight of the solvent.

In the suspension polymerization, the reaction may preferably be carried out using the monomer in an amount of not more than 100 parts by weight, and preferably from 10 to 90 parts by weight, based on 100 parts by weight of an aqueous solvent. Usable solvents include polyvinyl alcohol, partially saponified polyvinyl alcohol, and calcium phosphate, any of which may commonly be used in an amount of from 0.05 to 1 part by weight based on 100 parts by weight of the aqueous solvent. Polymerization temperature may be from 50° C. to 95° C. as a suitable range, and may appropriately be selected depending on the initiator used and the intended resin.

In the present invention, in order to achieve the object of the present invention, the high-molecular weight resin component of the vinyl resin having a carboxyl group may preferably be produced using a polyfunctional polymerization initiator alone or in combination with a monofunctional polymerization initiator which are as exemplified below.

As specific examples of a polyfunctional polymerization initiator having a polyfunctional structure, it may include polyfunctional polymerization initiators having in one molecule two or more functional groups such as peroxide groups, having a polymerization initiating function, as exemplified by 1,1-di-tert-butylperoxy-3,3,5-trimethylcyclohexane, 1,3-bis(tert-butylperoxyisopropyl)benzene, 2,5-dimethyl-2,5-(tert-butylperoxy)hexane, 2,5-dimethyl-2,5-di-(tert-butylperoxy)hexane, tris-(tert-butylperoxy)triazine, 1,1-di-tert-butylperoxycyclohexane, 2,2-di-tert-butylperoxybutane, 4,4-di-tert-butylperoxyvaleric acid-n-butyl ester, di-tert-butyl peroxyhexahydroterephthalate, di-tert-butyl peroxyazelate, di-tert-butyl peroxytrimethyladipate, 2,2-bis(4,4-di-tert-butylperoxycyclohexyl)propane, 2,2-di-tert-butylperoxyoctane, and various polymer oxides; and polyfunctional polymerization initiators having in one molecule both a functional group such as a peroxide group, having a polymerization initiating function, and a polymerizable unsaturated group, as exemplified by diallyl peroxydicarbonate, tert-butyl peroxymaleate, tert-butyl peroxyallylcarbonate, and tert-butyl peroxyisopropylfumarate.

Of these, more preferred ones are 1,1-di-tert-butylperoxy-3,3,5-trimethylcyclohexane, 1,1-di-tert-butylperoxycyclohexane, di-tert-butyl peroxyhexahydroterephthalate, di-tert-butyl peroxyazelate, 2,2-bis(4,4-di-tert-butylperoxycyclohexane)propane, and tert-butyl peroxyallylcarbonate.

In order to satisfy various performances required as binders for the toner, any of these polyfunctional polymerization initiators may preferably be used in combination with a monofunctional polymerization initiator. In particular, they may preferably be used in combination with a polymerization initiator having a half-life of 10 hours which is lower than the decomposition temperature necessary for the polyfunctional polymerization initiator to obtain a half-life of 10 hours.

Such a monofunctional polymerization initiator may specifically include organic peroxides such as benzoylperoxide, 1,1-di(tert-butylperoxy)-3,3,5-trimethylcyclohexane, n-butyl-4,4-di(tert-butylperoxy)valerate, dicumyl peroxide, α,α'-bis(tert-butylperoxydiisopropyl)benzene, tert-butylperoxycumene, and di-tert-butyl peroxide; and azo or diazo compounds such as azobisisobutylonitrile and diazoaminoazobenzene.

Any of these monofunctional polymerization initiators may be added to the monomers at the same time the polyfunctional polymerization initiator is added. In order to keep a proper efficiency of the polyfunctional polymerization initiator, the monofunctional polymerization initiator may preferably be added after the half-life the initiator shows has lapsed in the polymerization step.

Any of these polymerization initiators may preferably be added in an amount of 0.01 to 10 parts by weight based on 100 parts by weight of the monomer, in view of efficiency.

The vinyl resin having a carboxyl group may also be a polymer cross-linked optionally with a cross-linkable monomer as exemplified below.

Such a monomer may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxyethylene (2)-2,2-bis(4-hydroxyphenyl)propane diacrylate, polyoxyethylene (4)-2,2-bis(4-hydroxyphenyl)propane diacrylate, and the above compounds whose acrylate moiety has been replaced with methacrylate; and polyester type diacrylate compounds as exemplified by MANDA (trade name; available from Nippon Kayaku Co., Ltd.).

As trifunctional or higher cross-linkable monomers, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallyl cyanurate, and triallyl trimellitate.

Any of these cross-linkable monomers may preferably be used in an amount of from 0.01 to 10 parts by weight, and preferably from 0.03 to 5 parts by weight, based on 100 parts by weight of other monomer components.

Of these cross-linkable monomers, monomers preferably usable as resins for toners in view of fixing performance and anti-offset properties are aromatic divinyl compounds (in particular, divinylbenzene) and diacrylate compounds linked with a chain containing an aromatic group and an ether linkage.

As methods for synthesizing the low-molecular-weight resin component, known methods may be used. In bulk polymerization, polymers with a low-molecular weight can be obtained by polymerizing the monomer at a high temperature and accelerating the rate of termination reaction, but there is the problem of a difficulty in controlling the reaction. In this regard, in solution polymerization, low-molecular weight resins can be obtained with ease under mild conditions, utilizing a difference in chain transfer of radicals that is caused by a solvent, and controlling the quantity of initiators and the reaction temperature. Thus, this method is preferred in order to obtain the low-molecular weight resin component in the vinyl resin having a carboxyl group.

As the solvent used in the solution polymerization, xylene, toluene, cumene, cellosolve acetate, isopropyl alcohol or benzene may be used. Where styrene monomers are used, xylene, toluene or cumene is preferred. The solvent may appropriately be selected depending on the polymer to be produced. As to reaction temperature, which may differ depending on the solvent and polymerization initiator to be used and the polymer to be produced by polymerization, the reaction may be carried out usually at 70° C. to 230° C. In the solution polymerization, the monomer may preferably be used in an amount of from 30 to 400 parts by weight based on 100 parts by weight of the solvent.

It is also preferable to further mix other polymer in the solution when the polymerization is terminated. Several kinds of polymers may be mixed.

Meanwhile, the epoxy group in the vinyl resin having an epoxy group is meant to be a functional group in which an oxygen atom is united with two atoms of carbon in the same molecule, and has a cyclic ether structure. The cyclic ether structure may typically include rings of 3 members, 4 members, 5 members and 6 members. In particular, those of 3-member ring structure are preferred.

As a monomer having an epoxy group that constitutes the vinyl resin having an epoxy group, it may include the following.

It may include glycidyl acrylate, glycidyl methacrylate, β-methylglycidyl acrylate, β-methylglycidyl methacrylate, allyl glycidyl ether and allyl β-methylglycidyl ether. A glycidyl monomer represented by Formula (1) below may also preferably be used.

Formula (1)

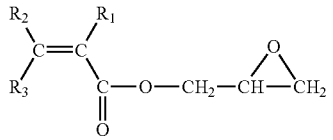

In Formula (1), $R_1$, $R_2$ and $R_3$ each represent a hydrogen atom, an alkyl group, an aryl group, an aralkyl group, a carboxyl group or an alkoxycarbonyl group.

As the vinyl resin having an epoxy group, it may be a vinyl resin obtained by polymerizing alone a monomer having an epoxy group, or may be a vinyl resin obtained by mixing the monomer with other vinyl monomer to effect copolymerization by a known polymerization method.

The vinyl resin having an epoxy group may preferably have, in molecular weight distribution measured by GPC of THF-soluble matter, a weight-average molecular weight (Mw) of from 2,000 to 100,000, more preferably form 2,000 to 50,000, and still more preferably from 3,000 to 40,000. If it has a weight-average molecular weight of less than 2,000, a large number of molecules may be cut in the kneading step even if molecules have grown in virtue of the cross-linking reaction in the binder resin, resulting in a low running performance. If it has a weight-average molecular weight of more than 100,000, it may lower fixing performance.

The vinyl resin having an epoxy group may also preferably have an epoxy value of from 0.05 to 5.0 eq/kg in order to achieve good fixing performance and anti-offset properties. If it has an epoxy value of less than 0.05 eq/kg, the cross-linking reaction may proceed with difficulty, and the high-molecular-weight resin component or THF-insoluble matter may be formed in a small quantity to make the toner have a low toughness. If it has an epoxy value of more than 5.0 eq/kg, the cross-linking reaction may proceed with ease but on the other hand a large number of molecules may be cut in the kneading step, tending to result in a low dispersibility of other materials.

The vinyl resin having an epoxy group may preferably be used in a mixing proportion that the epoxy group is in an equivalent weight of from 0.01 to 10.0, and more preferably in an equivalent weight of from 0.03 to 5.0, based on 1 equivalent weight of the carboxyl group in the vinyl resin having a carboxyl group.

If the epoxy group is less than 0.01 equivalent weight, the cross-linking points may be so few in the binder resin that the effect attributable to cross-linking reaction, such as running performance, may be brought out with difficulty. If on the other hand it is more than 10.0 equivalent weight, the cross-linking reaction may take place with ease but on the other hand a low dispersibility may result because of, e.g., the formation of excess THF-insoluble matter, to cause a lowering of pulverizability and a lowering of stability of development.

The vinyl resin having a carboxyl group and an epoxy group may be obtained by mixing a monomer having a carboxyl group and a monomer having an epoxy group, and copolymerizing the mixture with other vinyl monomer by a known polymerization method.

In the vinyl resin having a carboxyl group and an epoxy group, it may preferably have, in molecular weight distribution measured by GPC of THF-soluble matter, a number-average molecular weight of from 10,000 to 40,000 in order to achieve good developing performance and running performance, and may preferably have a weight-average molecular weight of from 10,000 to 10,000,000 in order to achieve good anti-offset properties, anti-blocking properties and running performance.

The vinyl resin having a carboxyl group and an epoxy group may preferably have an acid value of from 0.5 to 60 mg·KOH/g, where good fixing performance and anti-offset properties are brought out. If it has an acid value of less than 0.5 mg·KOH/g, the sites at which the carboxyl group and the epoxy group undergo cross-linking reaction are so few that the vinyl resin has only few cross-linking components, tending to result in a low running performance of the toner. In such a case, however, a vinyl resin having a carboxyl group and an epoxy group with a high epoxy value may be used to make compensation to a certain extent. If the vinyl resin having a carboxyl group and an epoxy group has an acid value of more than 60 mg·KOH/g, the binder resin in toner particles may have so strong a negative chargeability as to tend to result in a decrease in image density and an increase in fog when applied in positively chargeable toners.

The vinyl resin having a carboxyl group and an epoxy group may preferably have a glass transition point (Tg) of from 40° C. to 70° C. If it has a Tg of less than 40° C., the toner tends to have low anti-blocking properties. If it has a Tg of more than 70° C., the toner tends to have a low fixing performance.

The vinyl resin having an epoxy group and an epoxy group may also preferably have an epoxy value of from 0.05 to 5.0 eq/kg, where especially good fixing performance and anti-offset properties can be brought out. If it has an epoxy value of less than 0.05 eq/kg, the cross-linking reaction may proceed with difficulty, and the high-molecular-weight resin component or THF-insoluble matter may be formed in a small quantity to make the toner have a low toughness. If it has an epoxy value of more than 5.0 eq/kg, the cross-linking reaction may proceed with ease but on the other hand a large number of molecules may be cut in the kneading step, tending to result in a low dispersibility of other materials.

The vinyl resin having a carboxyl group and an epoxy group may preferably be used in a mixing proportion that the epoxy group is in an equivalent weight of from 0.01 to 10.0, and more preferably in an equivalent weight of from 0.03 to 5.0, based on 1 equivalent weight of the carboxyl group in this vinyl resin. If the epoxy group is less than 0.01 equivalent weight, the cross-linking points may be so few in the binder resin that the effect attributable to cross-linking reaction, such as running performance, may be brought out with difficulty. If on the other hand it is more than 10.0 equivalent weight, the cross-linking reaction may take place with ease but on the other hand a low dispersibility may result because of, e.g., the formation of excess THF-insoluble matter, to cause a lowering of pulverizability and a lowering of stability of development.

In the present invention, as described previously, a vinyl resin may also be used which is obtained by previously reacting the vinyl resin having a carboxyl group with the vinyl resin having an epoxy group when the resin is produced. As a means for the reaction carried out previously, (1) the vinyl resin having a carboxyl group and the vinyl resin having an epoxy group may be mixed in the state of a solution, followed by heating in a reaction vessel to cause the cross-linking reaction to take place, or (2) the vinyl resin having a carboxyl group and the vinyl resin having an epoxy group may each be taken out of a reaction vessel, and may be dry-blended by means of a Henschel mixer or the like, followed by heat melt-kneading by means of a twin extruder or the like to cause the cross-linking reaction to take place.

In the case when the above vinyl resin obtained by reacting the vinyl resin having a carboxyl group with the vinyl resin having an epoxy group is used, it may preferably be incorporated with from 0.1 to 60% by weight of THF-insoluble matter. In the case when the THF-insoluble matter is within this range, the resin itself can have an appropriate melt viscosity in the step of kneading in the production process, and hence uniform dispersion of materials can be achieved. If its THF-insoluble matter is more than 60% by weight, the resin itself may have so high a melt viscosity as to lower the dispersibility of materials.

In the present invention, the vinyl monomer to be copolymerized with the monomer having a carboxyl group and the monomer having an epoxy group may include the following.

Such a vinyl monomer may include, e.g., styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, 1-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. Any of these vinyl monomers may be used alone or in the form of a mixture of two or more monomers.

Of these, monomers may preferably be used in such a combination that may give a styrene copolymer and a styrene-acrylic copolymer. In this case, in view of fixing performance and mixing properties, such monomers may preferably contain at least 65% by weight of a styrene copolymer component or a styrene-acrylic copolymer component.

The binder resin in the toner of the present invention is further incorporated with the copolymer having an aliphatic conjugated diene compound as a monomer unit (the aliphatic conjugated diene copolymer).

The aliphatic conjugated diene copolymer may preferably be added in an amount of from 3 to 60% by weight, and particularly preferably from 5 to 50% by weight, in the binder resin. If the copolymer is added in an amount of less than 3% by weight, the effect to be brought by its addition may be exhibited with difficulty. If it is added in an amount of more than 60% by weight, the binder resin may have so high a softening point as to make it difficult to achieve good fixing performance.

The aliphatic conjugated diene compound that constitutes the aliphatic conjugated diene copolymer may include 1,3-butadiene, 2-methyl-1,3-butadiene, 2-ethyl-1,3-butadiene, 2-phenyl-1,3-butadiene, 2,3-dimethyl-1,3-butadiene, 1,4-diphenyl-1,3-butadiene, 1,1,4,4-tetraphenyl-1,3-butadiene, 1,3-pentadiene, 2-methyl-1,3-pentadiene, 2-ethyl-1,3-pentadiene, 3-methyl-1,3-pentadiene, 4-methyl-1,3-pentadiene, 1,3-hexadiene, 2,4-hexadiene, 2,3-dimethyl-1,3-hexadiene, 2,5-dimethyl-2,4-hexadiene, 1,3-heptadiene, 2,4-heptadiene, 2,3-dimethyl-1,3-heptadiene, 1,3-octadiene, 2,4-octadiene, 2,3-dimethyl-1,3-octadiene, 3;4-diethyl-1,3-octadiene, 1,3-nonadiene, 2,4-nonadiene, 2,3-dimethyl-1,3-nonadiene, and derivatives of these.

The aliphatic conjugated diene copolymer may also be obtained by effecting copolymerization using any of the vinyl monomers exemplified above in combination with one or two or more of the aliphatic conjugated diene compound. In particular, as the vinyl monomer, it is preferable to use styrene or a styrene derivative. As the aliphatic conjugated diene compound, it is preferable to use a monomer selected from the group consisting of 1,3-butadiene, 2-methyl-1,3-butadiene and 1,3-pentadiene.

It is also preferable to co-polymerize the styrene or styrene derivative with the aliphatic conjugated diene compound in a proportion of styrene or styrene derivative/aliphatic conjugated diene compound=65/35 to 98/2 in weight ratio.

A case in which the copolymerization proportion of the styrene or styrene derivative is less than 65% by weight is undesirable because the aliphatic conjugated diene copolymer has so low a glass transition point as to make the toner have a low storage stability. On the other hand a case in which the proportion is more than 98% by weight is undesirable because the aliphatic conjugated diene copolymer has so high a glass transition point as to make the toner have a low fixing performance.

The aliphatic conjugated diene copolymer may also preferably have, in molecular weight distribution measured by GPC of THF-soluble matter, a number-average molecular weight (Mn) of from 1,000 to 100,000, more preferably from 2,000 to 50,000, and particularly preferably from 3,000 to 30,000, and may preferably have a weight-average molecular weight (Mw) of from 10,000 to 1,000,000, more preferably from 20,000 to 500,000, and particularly preferably from 30,000 to 400,000.

In the case when the aliphatic conjugated diene copolymer has the above average molecular weights in a chromatogram of GPC of its THF-soluble matter, the toner can retain proper charge quantity and toughness, so that good developing stability, running performance, low-temperature fixing performance and anti-offset properties can be achieved.

If the aliphatic conjugated diene copolymer has a number-average molecular weight of less than 1,000 or a weight-average molecular weight of less than 10,000, the toner may have so low a melt viscosity that other materials may poorly be dispersed in toner particles to provide non-uniform charge distribution and make the fog low controllable, resulting in low developing performance, running performance and anti-offset properties. If the aliphatic conjugated diene copolymer has a number-average molecular weight of more than 100,000 or a weight-average molecular weight of more than 1,000,000, it may have a low compatibility with other binder resin components, so that the binder resin itself may have non-uniform component distribution, resulting in a low dispersibility of other materials, and resulting in low developing performance, running performance and fixing performance.

The aliphatic conjugated diene copolymer used in the present invention may preferably have a THF-insoluble matter in a content of 50% by weight or less. In the case when its THF-insoluble matter is in the content of 50% by weight or less, good low-temperature fixing performance and anti-offset properties can be achieved, and the contamination-preventive properties to fixing members can also be good.

If its THF-insoluble matter is in a content of more than 50% by weight, the THF-insoluble matter in the toner is in so large a content that the toner may have a low fixing performance. It may also come difficult to enclose the copolymer in the cross-linked component in the present invention, resulting in low developing performance and running performance.

Methods used in the present invention for synthesizing the aliphatic conjugated diene copolymer may include solution polymerization, suspension polymerization and emulsion polymerization which are known in the art. In particular, it is preferable to carry out copolymerization by solution polymerization or emulsion polymerization.

In the case when the aliphatic conjugated diene copolymer is produced by solution polymerization, known solvents may be used as polymerization solvents, as exemplified by isooctane, cyclohexane, n-hexane, benzene, toluene, xylene, ethylbenzene, and cis-2-butene. As polymerization catalysts, usable are a Ti type, an Ni type, an Li type and a Co type.

In the case when the aliphatic conjugated diene copolymer is produced by emulsion polymerization, water, monomers, and additives such as an emulsifying agent, an electrolyte, a polymerization initiator, a reducing agent, a chelating agent, an activator and a chain transfer agent may be used, and polymerization reaction may be carried out in a temperature range of from 0° C. to 100° C. in an emulsified state to obtain a latex containing the copolymer.

As the emulsifying agent, soaps such as fatty-acid soap and rosin soap may be used. Stated specifically, the fatty-acid soap is chiefly composed of a long-chain fatty-acid carboxylic acid having 12 to 18 carbon atoms as exemplified by lauric acid, myristic acid, stearic acid or oleic acid, and a sodium salt or potassium salt of a mixed fatty-acid carboxylic acid of these. Also, the rosin soap is chiefly composed of a sodium salt or potassium salt of a disproportionated or hydrogenated product of a natural rosin such as gum rosin, wood rosin or tall oil rosin. Such a natural rosin is chiefly composed of abietic acid, levopimaric acid, pulstric acid, dehydroabietic acid, tetrahydroabietic acid and neoabietic acid. Also usable are sodium alkylbenzenesulfonates, sodium alkylsulfonates, sodium salts of higher alcohol monosulfuric esters, and so forth. The emulsifying agent may preferably be used in its addition in an amount of form 0.1 to 10 parts by weight based on 100 parts by weight of the monomer.

As the electrolyte, usable are tetrasodium pyrophosphate, tetrapotassium pyrophosphate, trisodium phosphate and tripotassium phosphate, dipotassium hydrogenphosphate and disodium hydrogenphosphate, potassium carbonate and ammonium carbonate, potassium hydrogencarbonate and sodium hydrogencarbonate, and potassium sulfite and sodium sulfite. The electrolyte may be added in an amount changed appropriately in accordance with the adjustment of pH under reaction conditions.

The polymerization initiator may include persulfates such as potassium persulfate and ammonium persulfate, azo compounds such as 2,2'-azobis(isobutylonitrile) and 4,4'-azobis (4-cyanovaleric acid), organic peroxides such as benzoyl peroxide and methyl ethyl ketone peroxide, and redox type initiators composed of combination of i) any of organohydroperoxides such as diisopropylbenzene hydroperoxide, cumene hydroperoxide, p-menthane hydroperoxide, tert-butylisopropylbenzene hydroperoxide and cyclohexylbenzene hydroperoxide and ii) a reducing agent. The reducing agent may include chelates formed of formic acid, citric acid, metasilicic acid, ethylenediaminetetraacetic acid, ethylenedinitrotetraacetic acid or a sodium salt or potassium salt of any of these and a heavy metal such as iron, copper or chromium; and ferrous sulfate or ferrous pyrophosphate.

As the activator, usable are sodium sulfite, sodium hydrogensulfite, formaldehyde sodium sulfoxylate, and reducing sugars such as dextrose and fructose.

As the chain transfer agent, usable are mercaptans such as octyl mercaptan, n-dodecyl mercaptan, tert-dodecyl mercaptan, n-hexadecyl mercaptan, n-tetradecyl mercaptan, and tert-tetradecyl mercaptan; xanthogen disulfides such as dimethyl xanthogen disulfide, diethyl xanthogen disulfide, and diisopropyl xanthogen disulfide; thiuram disulfides such as tetramethylthiuram disulfide, tetraethylthiuram disulfide, and tetrabutylthiuram disulfide; halogenated hydrocarbons such as carbon tetrachloride, carbon tetrabromide, and ethylene bromide; hydrocarbons such as pentaphenylethane; and acrolein, methacrolein, allyl alcohol, 2-ethylhexyl thioglycolate, terpinolene, α-terpinene, γ-terpinene, diterpene, α-methylstyrene dimer, (one having 50% by weight or more of 2-4-diphenyl-4-methyl-1-pentene is preferred), 2,5-dihydrofuran, 3,6-dihydro-2H-pyran, phthalan, 1,2-butadiene, 1,4-hexadiene and so forth.

As to the polymerization initiator, the activator and the chain transfer agent, these may be used in their addition in an amount of 0.001 to 5 parts by weight each, based on 100 parts by weight of the monomer. This range is preferable because the molecular weight of the aliphatic conjugated diene copolymer can be adjusted.

As a short-stopper, it may include sodium dimethyldithiocarbamate, diethylhydroxylamine, hydroxylamine sulfonate, and alkali metal salts thereof; aromatic hydroxydithiocarboxylic acids such as hydroxydimethylbenzenedithiocarboxylic acid, hydroxydiethylbenzenedithiocarboxylic acid and hydroxydibutylbenzenedithiocarboxylic acid, and alkali metal salts thereof; hydroquinone derivatives, and catechol derivatives. The short-stopper may be used in its addition in an amount of 0.1 to 10 parts by weight based on 100 parts by weight of the monomer.

The latex obtained after the polymerization reaction may beforehand be subjected to alkali treatment, and then may be coagulated with a coagulant, followed by separation, water washing, dehydration and drying to obtain the aliphatic conjugated diene copolymer.

As the coagulant, an acid/metal salt may be used. The acid may include inorganic acids such as sulfuric acid and hydrochloric acid, and organic acids such as acetic acid and formic acid. Besides, a polymeric coagulant may also be used in combination. As the metal salt, metal salts of these acids may be used. The above metal salt may include sodium chloride, sodium bromide, potassium chloride, potassium bromide, calcium chloride, calcium nitrate, aluminum chloride, aluminum sulfate, and magnesium sulfate. As the polymeric coagulant, usable are polyamine, polyacrylic esters, polyacrylamide, quaternary ammonium salts, imidazoline derivatives, chitosan and so forth.

The coagulant may be used in its addition in an amount of from 0.1 to 20 parts by weight in respect of the acid, from 1 to 30 parts by weight in respect of the alkali metal salt, and from 0.01 to 5 parts by weight in the case of the polymeric coagulant, based on 100 parts by weight of the latex (solid content: 15% to 30%).

The aliphatic conjugated diene copolymer obtained may be vulcanized by adding a vulcanizer, a vulcanization accelerator, a vulcanization supplement accelerator, a deterioration preventive agent, a softening agent and so forth to cause intermolecular cross-linking reaction to take place to make the copolymer tough and make it endowed with stretchability and relaxativity.

As the vulcanizer, powdery sulfur, flower of sulfur, precipitated sulfur, colloidal sulfur, surface-treated sulfur or insoluble sulfur may be used in an amount ranging from 0.1 to 20 parts by weight based on 100 parts by weight of the copolymer. The vulcanization may also be carried out using the following vulcanization accelerator and vulcanization supplement accelerator in combination.

As the vulcanization accelerator, usable are zinc diethyldithiocarbamide, 4,4'-dithiodimorpholine, N,N-dimethyl-S-tert-butyl sulfenyldithiocarbamate, tetramethylthiuram disulfide, 2,2'-dibenzothiazyl disulfide, butylaldehyde aniline mercaptobenzothiazole, N-oxydiethylene-2-benzothiazole sulfenamide, N-cyclohexyl-2-benzothiazyl sulfenamide, 2-(4'-morpholinodithio)benzothiazole and so forth. As the vulcanization supplement accelerator, usable are zinc white, magnesium oxide, stearic acid and so forth. The vulcanization accelerator and the vulcanization supplement accelerator are often used in combination. The vulcanization accelerator may be used in its addition in an amount of from 0.1 to 20 parts by weight based on 100 parts by weight of the copolymer.

The deterioration preventive agent includes monophenol, bisphenols, polyphenols, hydroquinone derivatives, phosphorous salts or esters, phosphoric ester blends, thioesters, naphtylamine, diphenylamine, other diarylamine derivatives, p-phenylenediamine, quinoline, and other amines. The deterioration preventive agent may be used in an amount of from 0.1 to 5 parts by weight based on 100 parts by weight of the copolymer.

As the softening agent, usable are aromatic extracted oils such as asphalt and saturated or unsaturated hydrocarbons; petroleum softening agents containing a nitrogen base; and coal tar, coumarone-indene resin, dibutyl phthalate, tricresil phosphate and so forth. The softening agent may be used in an amount of from 0.1 to 20 parts by weight based on 100 parts by weight of the copolymer.

In the present invention, the binder resin in the toner may preferably contain at least i) a kneaded product obtained by melt-kneading a composition containing at least a vinyl resin having an acid value of from 0.5 to 60 mg·KOH/g and a vinyl resin having an epoxy value of from 0.05 to 5.0 eq/kg and ii) the copolymer having an aliphatic conjugated diene compound as a monomer component (the aliphatic conjugated diene copolymer), and in addition the binder resin in the toner may preferably have the THF-insoluble matter in a content of from 0.1% by weight to 60% by weight, and the copolymer having an aliphatic conjugated diene compound as a monomer component (the aliphatic conjugated diene copolymer) is incorporated in an o-dichlorobenzene-soluble matter of the THF-insoluble matter.

In the present invention, the binder resin in the toner may also preferably contain at least i) a kneaded product obtained by melt-kneading a composition containing at least a vinyl resin having an acid value of from 0.5 to 60 mg·KOH/g and an epoxy value of from 0.05 to 5.0 eq/kg and ii) the copolymer having an aliphatic conjugated diene compound as a monomer component (the aliphatic conjugated diene copolymer), and in addition the binder resin in the toner may preferably have the THF-insoluble matter in a content of from 0.1% by weight to 60% by weight, and the copolymer having an aliphatic conjugated diene compound as a monomer component (the aliphatic conjugated diene copolymer) is incorporated in an o-dichlorobenzene-soluble matter of the THF-insoluble matter.

As the binder resin used in the toner of the present invention, the following other polymer may also be added.

For example, usable are homopolymers of styrene or styrene derivatives such as polystyrene, poly-p-chlorostyrene, and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, and a styrene-acrylonitrile-indene copolymer; polyvinyl chloride, phenolic resins, natural-resin-modified phenol resins, natural-resin-modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone-indene resins, and petroleum resins.

The toner of the present invention may preferably be incorporated with a charge control agent to control positive chargeability or negative chargeability.

Charge control agents capable of controlling the toner to be positively chargeable include the following materials.

For example, they include Nigrosine and its products modified with fatty metal salts or the like; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides, and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; as well as guanidine compounds, and imidazole compounds. Any of these may be used alone or in combination of two or more types. Of these, triphenylmethane dyes, imidazole compounds, and quaternary ammonium salts whose counter ions are not halogens may preferably be used.

Charge control agents capable of controlling the toner to be negatively chargeable may include the following materials.

For example, organic metal complexes or chelate compounds are effective, which include monoazo metal complexes, acetylacetone metal complexes, aromatic hydroxycarboxylic acid metal complexes and aromatic dicarboxylic acid metal complexes. Besides, they include aromatic hydroxycarboxylic acid, aromatic monocarboxylic or polycarboxylic acids and metal salts, anhydrides or esters thereof, and phenol derivatives such as bisphenol.

As methods for incorporating the charge control agent in the toner, there are a method of adding it internally to toner particles and a method of adding it externally to toner particles. The amount of the charge control agent to be used depends on the type of the binder resin, the presence of any other additives, and the manner by which the toner is produced, including the manner of dispersion, and can not be absolutely specified. Preferably, the charge control agent may be used in an amount ranging from 0.1 to 10 parts by weight, and more preferably from 0.1 to 5 parts by weight, based on 100 parts by weight of the binder resin.

In the present invention, in order to impart release properties to the toner, a wax as shown below may preferably be incorporated in the toner. It may specifically include paraffin wax, microcrystalline wax, Fischer-Tropsch wax and montan wax; and also homopolymers or copolymers of straight-chain α-olefins such as ethylene, propylene, butene, pentene, hexene, heptene, octene, nonene and decene, branched α-olefins having a branched moiety at the terminal, and olefins having these unsaturated groups at different positions. Besides, alcohol waxes, fatty acid waxes, ester waxes and naturally occurring waxes may also be used. Also, particularly preferred is a wax having a melting point (m.p.) of from 70° C. to 165° C. and a melt viscosity of 1,000 mPa·s or lower at 160° C.

Also usable are modified waxes, made into block copolymers with vinyl monomers or subjected to graft modifications, and oxidized waxes, subjected to oxidation treatment.

Any of these waxes may previously be added and mixed in a polymer component when the toner is produced. In such a case, a method is preferred in which, when the resin component is prepared, the wax and a high-molecular weight resin component are preliminarily dissolved in a solvent and thereafter the resultant solution is mixed with a low-molecular weight resin component solution. By this method, phase separation at microscopic regions can be relaxed, the high-molecular weight resin component can be kept from undergoing re-agglomeration, and also a good state of dispersion with the low-molecular weight resin component can be achieved.

The wax may also preferably be added in an amount of from 0.1 to 20 parts by weight, and more preferably from 1 to 10 parts by weight, based on 100 parts by weight of the binder resin. Also, the wax may be added using two or more types of waxes in combination.

The toner to which any of these waxes has been added may preferably have a maximum peak in the region of from 70° C. to 140° C. in the endothermic curve measured with a differential scanning calorimeter (DSC). In the case when it has a maximum peak in that region, the toner can have good fixing performance and anti-offset properties. If its maximum peak is in the region of less than 70° C., the toner itself may have a low storage stability because of a plastic effect of the wax. If it is in the region of more than 140° C., the toner may have a low fixing performance.

As a colorant usable in the present invention, it may include any suitable pigments and dyes. For example, the pigments include carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary for maintaining optical density of fixed images, and may be added in an amount of from 0.1 to 20 parts by weight, and preferably from 0.2 to 10 parts by weight, based on 100 parts by weight of the binder resin. The dyes may also be used for the same purpose, and include, e.g., azo dyes, anthraquinone dyes, xanthene dyes and methine dyes, any of which may be added in an amount of from 0.1 to 20 parts by weight, and preferably from 0.3 to 10 parts by weight, based on 100 parts by weight of the binder resin.

In the toner of the present invention, a magnetic iron oxide may be used as the colorant so that the toner can be used as a magnetic toner.

The magnetic iron oxide may preferably have a number-average particle diameter of from 0.05 to 1.0 μm, more preferably from 0.1 to 0.6 μm, and particularly preferably from 0.1 to 0.4 μm.

As a method of measuring the number-average particle diameter of the magnetic iron oxide, particles of the magnetic iron oxide are photographed on an electron microscope H-700H (manufactured by Hitachi Ltd.) at 50,000 magnifications, and then printed off at an enlargement of twice so as to be finally 100,000 magnifications. Using this photograph, 100 particles of 0.03 μm or more in diameter are picked out at random, and the maximum lengths (μm) of individual particles are measured. Their average value is regarded as the number-average particle diameter.

In the present invention, the magnetic iron oxide may be incorporated in the toner in an amount of from 10 to 200 parts by weight, preferably from 20 to 170 parts by weight, and more preferably from 30 to 150 parts by weight, based on 100 parts by weight of the binder resin.

In the toner of the present invention, it is preferable to externally add fine silica powder in order to improve charge stability, developing performance, fluidity and running performance.

The fine silica powder used in the present invention may have a specific surface area of 30 $m^2/g$ or more, and particularly in the range of from 50 to 400 $m^2/g$, as measured by nitrogen adsorption according to the BET method. Such powder gives good results. The fine silica powder may be used in an amount of from 0.01 to 8 parts by weight, and preferably from 0.1 to 5 parts by weight, based on 100 parts by weight of the toner.

For the purpose of making hydrophobic, controlling chargeability and so forth, it is preferable for the fine silica powder used in the present invention, to have optionally been treated with a treating agent such as a silicone varnish, a modified silicone varnish of various types, a silicone oil, a modified silicone oil of various types, a silane coupling agent, a silane compound having a functional group, or other organosilicon compound, or treated with various treating agents used in combination.

Other external additives may also optionally be added to the toner of the present invention.

Such external additives may include, e.g., a charging auxiliary agent, a conductivity-providing agent, a fluidity-providing agent, an anti-caking agent, and fine resin particles or inorganic fine particles which act as a release agent, a lubricant or an abrasive at the time of heat-roller fixing.

For example, the lubricant may include polyfluoroethylene powder, zinc stearate powder and polyvinylidene fluoride powder; in particular, polyvinylidene fluoride powder is preferred. The abrasive may include cerium oxide powder, silicon carbide powder and strontium titanate powder; in particular, strontium titanate powder is preferred. The fluidity-providing agent may include titanium oxide powder and aluminum oxide powder; in particular, hydrophobic one is preferred. The conductivity-providing agent may include carbon black powder, zinc oxide powder, antimony oxide powder and tin oxide powder. White fine particles and black fine particles having opposite polarity may also be used as a developing performance improver in a small quantity.

To produce the toner of the present invention, the binder resin, the colorant and other additives may thoroughly be mixed by means of a mixing machine such as a Henschel mixer or a ball mill, and then the mixture obtained may be melt-kneaded by means of a heat kneading machine such as a heat roll, a kneader or an extruder, followed by cooling for solidification and thereafter pulverization and circularity. Any desired additive(s) may further optionally thoroughly be mixed by means of a mixing machine such as a Henschel mixer. Thus, the toner of the present invention can be obtained.

As the mixing machine, it may include, e.g., Henschel Mixer (manufactured by Mitsui Mining & Smelting Co., Ltd.); Super Mixer (manufactured by Kawata K.K.); Conical Ribbon Mixer (manufactured by Ohkawara Seisakusho K.K.); Nauta Mixer, Turbulizer and Cyclomix (manufactured by Hosokawa Micron Corporation); Spiral Pin Mixer (manufactured by Taiheiyo Kiko K.K.); and Loedige Mixer (manufactured by Matsubo K.K.). As the kneading machine, it may include KRC Kneader (manufactured by Kurimoto Tekkosho K.K.); Buss-Kneader (manufactured by Buss Co.); TEM-type Extruder (manufactured by Toshiba Machine Co., Ltd.); TEX Twin-screw Extruder (manufactured by Nippon Seiko K.K.); PCM Kneader (manufactured by Ikegai Tekkosho K.K.); Three-Roll Mill, Mixing Roll Mill, and Kneader (manufactured by Inoue Seisakusho K.K.); Kneadex (manufactured by Mitsui Mining & Smelting Co., Ltd.); MS-type Pressure Kneader, Kneader-Ruder (manufactured by Moriyama Seisakusho K.K.); and Banbury Mixer (manufactured by Kobe Seikosho K.K.). As a grinding machine, it may include Counter Jet Mill, Micron Jet and Inomizer (manufactured by Hosokawa Micron Corporation); IDS-type Mill and PJM Jet Grinding Mill (manufactured by Nippon Pneumatic Kogyo K.K.); Cross Jet Mill (manufactured by Kurimoto Tekkosho K.K.); Ulmax (manufactured by Nisso Engineering K.K.); SK Jet O-Mill (manufactured by Seishin Kigyo K.K.); Criptron (manufactured by Kawasaki Heavy Industries, Ltd); and Turbo Mill (manufactured by Turbo Kogyo K.K.). As a classifier, it may include Classyl, Micron Classifier and Spedic Classifier (manufactured by Seishin Kigyo K.K.); Turbo Classifier (manufactured by Nisshin Engineering K.K.); Micron Separator, Turboprex(ATP) and TSP Separator (manufactured by Hosokawa Micron Corporation); Elbow Jet (manufactured by Nittestsu Kogyo K.K.); Dispersion Sparator (manufactured by Nippon Pneumatic Kogyo K.K.); and YM Microcut (manufactured by Yasukawa Shoji K.K.). As a sifter used to sieve coarse powder and so forth, it may include Ultrasonics (manufactured by Koei Sangyo K.K.); Rezona Sieve and Gyro Sifter (manufactured by Tokuju Kosakusho K.K.); Vibrasonic Sifter (manufactured by Dulton Co.); Sonicreen (manufactured by Shinto Kogyo K.K.); Turbo-Screener (manufactured by Turbo Kogyo K.K.); Microsifter (manufactured by Makino Sangyo K.K.); and circular vibrating screens.

Methods for the measurement of physical properties according to the present invention are shown below.

Measurement of THF-insoluble Matter:

The toner is weighed in an amount of from 1.0 to 2.0 g ($W_1$ g), which is then put in a cylindrical filter paper (e.g., No. 86R, available from Toyo Roshi K.K.) and set on a Soxhlet extractor. Extraction is carried out for 10 hours using 200 ml of tetrahydrofuran (THF) as a solvent, and the soluble component solution extracted by the use of the solvent is evaporated, followed by vacuum drying at 100° C.

for several hours. Then the THF-soluble resin component is weighed ($W_2$ g). Meanwhile, the weight of incineration residue ash content is also determined ($W_3$ g) in the following way.

Incineration residue ash content is determined in the following way. About 2.0 g of a sample is put in a 30 ml magnetic crucible weighed previously precisely, and the sample weight ($W_a$ g) is precisely weighed. The crucible is put in an electric furnace, and is heated at about 900° C. for about 3 hours, followed by leaving to cool in the electric furnace, and then leaving to cool in a desiccator for 1 hour or more at normal temperature, where the weight of the crucible is precisely weighed. From the weight, the incineration residue ash content ($W_b$ g) is determined.

Incineration residue ash content=$W_b/W_a$.

From this content, the weight ($W_3$ g) of incineration residue ash content in the sample is given as follows:

$$W_3=W_1\times(W_b/W_a).$$

Therefore, the THF-insoluble matter is determined from the following expression.

$$\text{THF-insoluble matter (\%)}=[\{W_1-(W_3+W_2)\}/(W_1-W_3)]\times 100.$$

Incidentally, to measure the THF-insoluble matter of samples not containing components other than the resin, such as the binder resin, the resin weighed in a stated quantity ($W_1$ g) is put to the same steps as the above to determine THF-soluble matter ($W_2$ g). The THF-insoluble matter is determined from the following expression.

$$\text{THF-insoluble matter (\%)}=\{(W_1-W_2)/W_1\}\times 100.$$

Measurement of o-Dichlorobenzene-d4-Soluble matter in THF-Insoluble Matter by NMR (Nuclear magnetic Resonance):

Where a magnetic material is contained in the toner, the magnetic material is removed by the following operation. First, at room temperature, 10 g of THF-insoluble matter obtained by the above measurement of THF-insoluble matter is added to 100 ml of concentrated hydrochloric acid (about 12 M), followed by stirring for 70 hours to dissolve the magnetic material contained in the toner. Next, filtration and washing are carried out until the filtrate turns weakly acidic (pH: about 5). The resin composition thus obtained is vacuum-dried at 50° C. for 24 hours to prepare a measuring-preliminary sample. About 50 mg of this measuring preliminary sample is put into a sample tube of 5 mm in diameter, and o-dichlorobenzene-d4 is added as a solvent, followed by dissolution to obtain a measuring sample. Conditions for measurement are shown below.

Measuring instrument: FT NMR device JNM-EX400 (manufactured by Nippon Denshi K.K.).

Measurement frequency: 400 MHz.

Pulse condition: 6.9 μs.

Data points: 32,768.

Frequency range: 10,500 Hz.

Integration times: 16 times.

Measurement temperature: 25° C.

Measurement of Molecular Weight Distribution by GPC:

Columns are stabilized in a heat chamber of 40° C. To the columns kept at this temperature, THF as a solvent is flowed at a flow rate of 1 ml per minute, and about 100 μl of a sample THF solution is injected thereinto to make measurement. In measuring the molecular weight of the sample, the molecular weight distribution ascribed to the sample is calculated from the relationship between the logarithmic value of a calibration curve prepared using several kinds of monodisperse polystyrene standard samples and the value of count. As the standard polystyrene samples used for the preparation of the calibration curve, it is suitable to use samples with molecular weights of from $10^2$ to $10^7$, which are available from, e.g., Tosoh Corporation or Showa Denko K.K., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H ($H_{XL}$), G2000H($H_{XL}$), G3000H($H_{XL}$), G4000H($H_{XL}$), G5000H($H_{XL}$), G6000H($H_{XL}$), G7000H($H_{XL}$) and TSK guard column, available from Tosoh Corporation.

The sample is prepared in the following way.

The sample (toner, resin) is put in THF, and is left for several hours, followed by thorough shaking so as to be well mixed with the THF (until coalescent matter of the sample has disappeared), which is further left for at least 12 hours. Here, the sample is so left as to stand in THF for at least 24 hours in total. Thereafter, the solution having been passed through a sample-treating filter (pore size: 0.2 to 0.5 μm; for example, MAISHORIDISK H-25-5, available from Tosoh Corporation, may be used) is used as the sample for GPC. The sample is so adjusted as to have resin components in a concentration of from 0.5 to 5 mg/ml.

Measurement of Acid Value (JIS Acid Value):

Basic operation is made according to JIS K-0070.

(1) A sample is used after the THF-insoluble matter of the toner and binder resin has been removed, or the THF-soluble component obtained in the above measurement of THF-insoluble matter, which has been extracted with THF solvent by means of the Soxhlet extractor, is used as a sample. A crushed product of the sample is precisely weighed in an amount of from 0.5 to 2.0 g, and the weight of the soluble component is represented by W (g).

(2) The sample is put in a 300 ml beaker, and 150 ml of a toluene/ethanol (4/1:v/v) mixed solvent is added thereto to dissolve the sample.

(3) Using an ethanol solution of 0.1 mol/l of KOH, titration is made by means of a potentiometric titrator. For example, automatic titration may be utilized which is made using a potentiometric titrator AT-400 (Win Workstation), manufactured by Kyoto Denshi K.K. and an ABP-410 motor buret.)

(4) The amount of the KOH solution used here is represented by S (ml). A blank is measured at the same time, and the amount of the KOH solution used in this blank is represented by B (ml).

(5) The acid value is calculated according to the following expression. Letter symbol f is the factor of KOH.

$$\text{Acid value (mg·KOH/g)}=\{(S-B)\times f\times 5.61\}/W.$$

Measurement of Glass Transition Temperature:

Measured according to ASTM D3418-82, using a differential scanning calorimeter (DSC measuring instrument) DSC-7, manufactured by Perkin-Elmer Corporation.

A sample for measurement is precisely weighed in an amount of 5 to 20 mg, preferably 10 mg. This sample is put in a pan made of aluminum and an empty aluminum pan is used as reference. Measurement is made in a normal-temperature normal-humidity (23° C./60% RH) environment at a heating rate of 10° C./min within the temperature range of from 30° C. to 200° C. In the course of this heating, changes in specific heat are obtained in the temperature range of from 40° C. to 100° C. The point at which the middle-point line between the base lines of a differential thermal curve before and after the appearance of the changes in specific heat thus obtained and the differential thermal curve intersect is regarded as the glass transition point Tg.

Measurement of Epoxy Value:

Basic operation is made according to JIS K-7236.

(1) A sample is precisely weighed in an amount of from 0.5 to 2.0 g, and its weight is represented by W (g).

(2) The sample is put in a 300 ml beaker, and is dissolved in a mixture of 10 ml of chloroform and 20 ml of acetic acid.

(3) To the resultant solution, 10 ml of tetraethylammonium bromide acetic acid solution is added. Using an acetic acid solution of 0.1 mol/l of perchloric acid, titration is made by means of a potentiometric titrator. (For example, automatic titration may be utilized which is made using a potentiometric titrator AT-400, Win Workstation, and an ABP-410 motor buret, both manufactured by Kyoto Denshi K.K.). The amount of the acetic acid solution of perchloric acid used here is represented by S (ml). A blank is measured at the same time, and the amount of the acetic acid solution of perchloric acid used in this blank is represented by B (ml).

The epoxy value is calculated from the following expression. Letter symbol f is the factor of acetic acid solution of perchloric acid.

$$\text{Epoxy value (eq/kg)}=\{0.1\times f\times(S-B)\}/W.$$

EXAMPLES

The present invention is described below in greater detail by giving Examples specifically. The present invention is by no means limited to these.

Production Example A-1 of High-molecular Weight Resin Component

| | (by weight) |
|---|---|
| Styrene | 80.3 parts |
| n-Butyl acrylate | 16.5 parts |
| Methacrylic acid | 3.2 parts |
| 2,2-Bis(4,4-di-tert-butylperoxycyclohexyl)propane | 0.8 part |

In a four-necked flask, with stirring of 200 parts by weight of xylene, the inside of the container was well displaced with nitrogen and was heated to 120° C., and thereafter the above materials were dropwise added thereto over a period of 4 hours. Further, under reflux of xylene, polymerization was completed, and the solvent was evaporated off under reduced pressure. The resin thus obtained is designated as Resin A-1.

Production Example A-2 of High-molecular Weight Resin Component

Resin A-2 was obtained in the same manner as in Production Example A-1 except that the materials used in Production Example A-1 were changed to the following.

| | (by weight) |
|---|---|
| Styrene | 82.7 parts |
| n-Butyl acrylate | 16.9 parts |
| Acrylic acid | 0.4 part |
| 2,2-Bis(4,4-di-tert-butylperoxycyclohexyl)propane | 0.8 part |

Production Example A-3 of High-molecular Weight Resin Component

Resin A-3 was obtained in the same manner as in Production Example A-1 except that the materials used in Production Example A-1 were changed to the following.

| | (by weight) |
|---|---|
| Styrene | 79.8 parts |
| n-Butyl acrylate | 16.4 parts |
| Methacrylic acid | 2.8 parts |
| Glycidyl methacrylate | 1.0 part |
| 2,2-Bis(4,4-di-tert-butylperoxycyclohexyl)propane | 0.8 part |

Production Example A-4 of High-molecular Weight Resin Component

Resin A-4 was obtained in the same manner as in Production Example A-1 except that the materials used in Production Example A-1 were changed to the following.

| | (by weight) |
|---|---|
| Styrene | 77.2 parts |
| n-Butyl acrylate | 15.8 parts |
| Acrylic acid | 7 parts |
| 2,2-Bis(4,4-di-tert-butylperoxycyclohexyl)propane | 0.8 part |

Production Example A-5 of High-molecular Weight Resin Component

Resin A-5 was obtained in the same manner as in Production Example A-1 except that the materials used in Production Example A-1 were changed to the following.

| | (by weight) |
|---|---|
| Styrene | 83 parts |
| n-Butyl acrylate | 17 parts |
| 2,2-Bis(4,4-di-tert-butylperoxycyclohexyl)propane | 0.8 part |

Production Example A-6 of High-molecular Weight Resin Component

Resin A-6 was obtained in the same manner as in Production Example A-1 except that the materials used in Production Example A-1 were changed to the following.

| | (by weight) |
|---|---|
| Styrene | 75.5 parts |
| n-Butyl acrylate | 15.5 parts |
| Acrylic acid | 9 parts |
| 2,2-Bis(4,4-di-tert-butylperoxycyclohexyl)propane | 0.8 part |

Production Example B-1 of Vinyl Resin Having Carboxyl Groups

| | (by weight) |
|---|---|
| Resin A-1 | 30 parts |
| Styrene | 57.5 parts |
| n-Butyl acrylate | 11.8 parts |
| Methacrylic acid | 0.7 part |
| Di-tert-butyl peroxide | 1.4 parts |

The above materials were dropwise added to 200 parts by weight of xylene over a period of 4 hours. Further, under reflux of xylene, polymerization was completed, and the solvent was evaporated off under reduced pressure. The resin thus obtained is designated as Resin B-1. Resin physical properties are shown in Table 1.

Production Example B-2 of Vinyl Resin Having Carboxyl Groups

Resin B-2 was obtained in the same manner as in Production Example B-1 except that the materials used in Production Example B-1 were changed to the following.

| | (by weight) |
|---|---|
| Resin A-2 | 30 parts |
| Styrene | 58.1 parts |
| n-Butyl acrylate | 11.9 parts |
| Di-tert-butyl peroxide | 1.4 parts |

Resin physical properties are shown in Table 1.

Production Example B-3 of Vinyl Resin Having Carboxyl Groups

Resin B-3 was obtained in the same manner as in Production Example B-1 except that the materials used in Production Example B-1 were changed to the following.

| | (by weight) |
|---|---|
| Resin A-3 | 30 parts |
| Styrene | 58.1 parts |

-continued

| | (by weight) |
|---|---|
| n-Butyl acrylate | 11.9 parts |
| Di-tert-butyl peroxide | 1.4 parts |

Resin physical properties are shown in Table 1.

Production Example B-4 of Vinyl Resin Having Carboxyl Groups

Resin B-4 was obtained in the same manner as in Production Example B-1 except that the materials used in Production Example B-1 were changed to the following.

| | (by weight) |
|---|---|
| Resin A-4 | 30 parts |
| Styrene | 54.8 parts |
| n-Butyl acrylate | 11.2 parts |
| Acrylic acid | 4 parts |
| Di-tert-butyl peroxide | 1.4 parts |

Resin physical properties are shown in Table 1.

Production Example B-5 of Vinyl Resin Having no Carboxyl Group

Resin B-5 was obtained in the same manner as in Production Example B-1 except that the materials used in Production Example B-1 were changed to the following.

| | (by weight) |
|---|---|
| Resin A-5 | 50 parts |
| Styrene | 41.5 parts |
| n-Butyl acrylate | 8.5 parts |
| Di-tert-butyl peroxide | 1.0 parts |

Resin physical properties are shown in Table 1.

Production Example B-6 of Vinyl Resin Having Carboxyl Groups

Resin B-6 was obtained in the same manner as in Production Example B-1 except that the materials used in Production Example B-1 were changed to the following.

| | (by weight) |
|---|---|
| Resin A-6 | 30 parts |
| Styrene | 57.8 parts |
| n-Butyl acrylate | 11.2 parts |
| Acrylic acid | 4.0 parts |
| Di-tert-butyl peroxide | 1.4 parts |

Resin physical properties are shown in Table 1.

Production Example B-7 of Vinyl Resin Having Carboxyl Groups

Resin B-7 was obtained in the same manner as in Production Example B-1 except that the materials used in Production Example B-1 were changed to the following.

| | (by weight) |
|---|---|
| Resin A-2 | 50 parts |
| Styrene | 41.5 parts |
| n-Butyl acrylate | 8.5 parts |
| Di-tert-butyl peroxide | 1.0 part |

Resin physical properties are shown in Table 1.

Production Example C-1 of Vinyl Resin Having Epoxy Groups

| | (by weight) |
|---|---|
| Styrene | 82.2 parts |
| n-Butyl acrylate | 16.8 parts |
| Glycidyl methacrylate | 1 part |
| Di-t-butyl peroxide | 5 parts |

In a four-necked flask, with stirring of 200 parts by weight of xylene, the inside of the container was well displaced with nitrogen and was heated to 120° C., and thereafter the above materials were dropwise added thereto over a period of 4 hours. Further, under reflux of xylene, polymerization was completed, and the solvent was evaporated off under reduced pressure. The resin thus obtained is designated as Resin C-1. Resin physical properties of Resin C-1 obtained are shown in Table 2.

Production Example C-2 of Vinyl Resin Having Epoxy Groups

Resin C-2 was obtained in the same manner as in Production Example C-1 except that the materials used in Production Example C-1 were changed to the following.

| | (by weight) |
|---|---|
| Styrene | 74.7 parts |
| n-Butyl acrylate | 15.3 parts |
| Glycidyl methacrylate | 10 parts |
| Di-t-butyl peroxide | 5 parts |

Resin physical properties of Resin C-2 obtained are shown in Table 2.

Production Example C-3 of Vinyl Resin Having Epoxy Groups

Resin C-3 was obtained in the same manner as in Production Example C-1 except that the materials used in Production Example C-1 were changed to the following.

| | (by weight) |
|---|---|
| Styrene | 25.0 parts |
| n-Butyl acrylate | 5.0 parts |
| Glycidyl methacrylate | 70 parts |
| Di-t-butyl peroxide | 5 parts |

Resin physical properties of Resin C-3 obtained are shown in Table 2.

Production Example D-1 of Aliphatic Conjugated Diene Copolymer

| | (by weight) |
|---|---|
| Styrene | 85 parts |
| 1,3-Butadiene | 15 parts |
| Potassium abietate | 2 parts |
| Potassium stearate | 2 parts |
| Tetrapotassium pyrophosphate | 0.3 part |
| p-Menthane hydroperoxide | 0.1 part |
| Sodium ethylenediaminetetraacetate | 0.03 part |
| Ferrous sulfate | 0.01 part |
| Formaldehyde sodium sulfoxylate | 0.1 part |
| tert-Dodecyl mercaptan | 0.25 part |

The above component materials were added to 200 parts by weight of water to start polymerization reaction at a reaction temperature of 5° C. Upon polymerization conversion of 60%, 0.2 part by weight of sodium dimethyl dithiocarbamate was added to stop the polymerization. Thereafter, the remaining monomer was removed by heating to obtain a latex. The latex obtained was subjected to alkali treatment, and 400 parts by weight of an aqueous 1% aluminum sulfate solution was added to 100 parts by weight of the latex. The polymer having coagulated was separated, followed by water washing, dehydration and drying to obtain a copolymer (a). To 100 parts by weight of the copolymer (a) obtained, additives were added in the formulation shown below, followed by heating at 160° C. for 20 minutes by the pressure process to obtain Copolymer D-1.

| | (by weight) |
|---|---|
| Copolymer (a) | 100 parts |
| Zinc oxide | 3 parts |
| Stearic acid | 2 parts |
| Sulfur | 1.5 parts |
| N-cyclohexyl-2-benzothiazyl sulfenamide | 1.2 parts |

As shown in Table 3, Copolymer D-1 obtained was: number-average molecular weight (Mn)=7,000, weight-average molecular weight (Mw)=250,000 and peak molecular weight (Mp)=20,000. Its THF-insoluble matter=3%.

Production Example D-2 of Aliphatic Conjugated Diene Copolymer

Copolymer D-2 was obtained in the same manner as in Production Example D-1 except that the amount of the sulfur was changed to 0.5 part by weight, and conditions for the pressure process were changed to 180° C. an 40 minutes. Copolymer D-2 obtained was: Mn=14,000, Mw=50,000, Mp=20,000, and THF-insoluble matter=2%.

Production Example D-3 of Aliphatic Conjugated Diene Copolymer

Copolymer D-3 was obtained in the same manner as in Production Example D-1 except that the amount of the sulfur was changed to 5.0 parts by weight, and conditions for the pressure process were changed to 160° C. an 40 minutes. Copolymer D-3 obtained was: Mn=20,000, Mw=100,000, Mp=50,000, and THF-insoluble matter=55%.

Example 1

Resin B-1 vinyl resin having carboxyl groups and Resin C-1 vinyl resin having epoxy groups were used in amounts of 95 parts by weight and 5 parts by weight, respectively, and these were mixed by means of a Henschel mixer. Thereafter, the mixture obtained was kneaded at 160° C. by means of a twin-screw extruder to cause cross-linking reaction to take place between the carboxyl groups and the epoxy groups, followed by cooling and pulverization to obtain Vinyl Resin 1. The THF-insoluble matter of Vinyl Resin 1 formed was in a content of 3%.

| | (by weight) |
|---|---|
| Vinyl Resin 1 | 80 parts |
| Copolymer D-1 | 20 parts |
| Magnetic iron oxide (number-average particle diameter: 0.2 μm; saturation magnetization ((σs): 84.5 $Am^3$/kg, measured in a magnetic field of 795.8 kA/m; residual magnetization (σr): 10.9 $Am^3$/kg, measured in a magnetic field of 795.8 kA/m) | 90 parts |
| Fischer-Tropsch wax (melting point: 105° C.) | 2 parts |
| Paraffin wax (melting point: 75.7° C.) | 4 parts |
| Triphenylmethane lake pigment | 2 parts |

The above materials were well premixed by means of a Henschel mixer. Thereafter, the mixture obtained was melt-kneaded by means of a twin-screw extruder set to 130° C. The kneaded product obtained was cooled, and then crushed using a cutter mill. Thereafter, the crushed product was finely pulverized by means of a fine grinding mill making use of jet streams. The resultant finely pulverized product was classified by means of an air classifier to obtain a classified fine powder (toner particles) having a weight-average particle diameter of 7.5 μm.

To 100 parts by weight of the classified fine powder thus obtained, 0.8 part by weight of hydrophobic silica silica powder [BET specific surface area: 130 $m^2$/g; obtained by treating 100 parts by weight of a silica base material produced by the dry process, with 17 parts by weight of amino-modified silicone oil (amine equivalent weight: 830; viscosity at 25° C.: 70 $mm^2$/s)] and 3.0 parts by weight of strontium titanate were added. These were mixed by means of a Henschel mixer, followed by sieving with a filter having a mesh size of 150 μm to obtain Toner 1. Physical properties of Toner 1 are shown in Table 4, which is comprised of Tables 4 (A) and 4 (B).

A measurement chart obtained by $^1$H-NMR measurement made on the THF-insoluble matter in the resin component of Toner 1, making use of o-dichlorobenzene-d4 as a solvent, is shown in Figure. Signals due to protons bonding to unsaturated-bond moieties of the diene compound are observed in the vicinity of 5.1 ppm. Thus, it was ascertained that the aliphatic conjugated diene compound was contained in the THF-insoluble matter of the toner resin component in the state it was soluble in the o-dichlorobenzene. Signals due to protons bonding to the benzene ring of styrene are also seen in the vicinities of 6.6 ppm to 7.2 ppm. The ratio of the proton integral value due to styrene to the proton integral value due to diene compound was found to be 1/44.6=0.022.

In respect of Toner 1 thus obtained, the following evaluation tests were made. Regarding the results of evaluation, they are shown in Table 5.

—Image Evaluation Test—

Using a commercially available copying machine IR-8500 (manufactured by CANON INC.), copies of a test chart having a print percentage of 4% were continuously taken on 100,000 sheets in a normal temperature/normal humidity environment (N/N; 23° C./60% RH). Separately therefrom, copies of a test chart having a print percentage of 4% were also continuously taken on 50,000 sheets in each of a normal temperature/low humidity environment (N/L; 23° C./5% RH) and a high temperature/high humidity environment (H/H; 32.5° C./80% RH). After the continuous copying was finished, image evaluation (on image density and fog) and evaluation of contamination-preventive properties to fixing separation claws were made in the following way.

In regard to the image density, a solid black image was copied as an evaluation sample, and its image density was measured with "Macbeth Reflection Densitometer" (manufactured by Macbeth Co.). In respect of the fog, the reflection density of transfer sheet and the reflection density of transfer sheet after the copying of a solid white image were measured with "Reflection Densitometer" (manufactured by Tokyo Denshoku Gijutsu Center K.K.), and a difference between them was regarded as fog value.

To evaluate the contamination-preventive properties to fixing separation claws, how fixing separation claws came contaminated and fixed images were visually observed after the continuous copying was finished, and evaluation was made according to the following evaluation criteria.

Fixing Separation Claws Contamination Level Ranks

A: No contamination has occurred at all.

B: Contamination has occurred, but no problem in practical use.

C: Faulty images caused by contamination appear slightly.

D: Faulty images caused by contamination appear conspicuously.

—Low-temperature Fixing Performance Test—

A fixing unit of a commercially available copying machine IR-8500 (manufactured by CANON INC.) was remodeled into an external fixing assembly in such a way that it was operable also outside the copying machine, its fixing temperature was able to be arbitrarily set and the process speed was set to 500 mm/sec. Using this fixing assembly, unfixed toner images transferred to sheets of paper of 80 g/$m^2$ basis weight were fixed to evaluate fixing performance. Temperature was controlled at intervals of 5° C. in the temperature range of from 140° C. to 190° C., and the unfixed toner images were fixed at each temperature. The images thus obtained were back and forth rubbed five times with Silbon paper under application of a load of 4.9 kPa. The point at which the rate of decrease in image density before and after the rubbing came to 10% was regarded as fixing start temperature. The lower this temperature is, the better the fixing performance is. The evaluation was made in a normal temperature/normal humidity environment (N/N; 23° C./60% RH).

—Anti-offset Properties Evaluation Test—

The above external fixing assembly was so remodeled to have a process speed of 50 mm/sec, and unfixed toner images transferred to sheets of paper of 50 g/m$^2$ basis weight were fixed to evaluate fixing performance. Temperature was controlled at intervals of 5° C. in the temperature range of from 190° C. to 240° C., and how offset occurs was observed to measure the temperature at which the offset occurred. The evaluation was made in a normal temperature/normal humidity environment (N/N; 23° C./60% RH).

Example 2

Resin B-2 vinyl resin having carboxyl groups and Resin C-2 vinyl resin having epoxy groups were used in amounts of 90 parts by weight and 10 parts by weight, respectively, and these were mixed by means of a Henschel mixer. The mixture obtained was kneaded at 180° C. by means of a twin-screw extruder to cause cross-linking reaction to take place, followed by cooling and pulverization to obtain Vinyl Resin 2. The THF-insoluble matter of Vinyl Resin 2 obtained was in a content of 20%.

Toner 2 was obtained in the same manner as in Example 1 except that Vinyl Resin 1 was changed to Vinyl Resin 2. Evaluation was made on this Toner 2 in the same manner as in Example 1. Physical properties of the toner are shown in Tables 4 (A) and 4 (B), and the results of evaluation in Table 5.

Example 3

Resin B-3 vinyl resin having carboxyl groups and epoxy groups and Resin C-1 vinyl resin having epoxy groups were used in amounts of 95 parts by weight and 5 parts by weight, respectively, and these were mixed by means of a Henschel mixer. The mixture obtained was kneaded at 160° C. by means of a twin-screw extruder to cause cross-linking reaction to take place, followed by cooling and pulverization to obtain Vinyl Resin 3. The THF-insoluble matter of Vinyl Resin 3 obtained was in a content of 1%.

Toner 3 was obtained in the same manner as in Example 1 except that Vinyl Resin 1 was changed to Vinyl Resin 3. Evaluation was made on this Toner 3 in the same manner as in Example 1. Physical properties of the toner are shown in Tables 4 (A) and 4 (B), and the results of evaluation in Table 5.

Example 4

Resin B-4 vinyl resin having carboxyl groups and Resin C-1 vinyl resin having epoxy groups were used in amounts of 95 parts by weight and 5 parts by weight, respectively, and these were mixed by means of a Henschel mixer. The mixture obtained was kneaded at 170° C. by means of a twin-screw extruder to cause cross-linking reaction to take place, followed by cooling and pulverization to obtain Vinyl Resin 4. The THF-insoluble matter of Vinyl Resin 4 obtained was in a content of 25%.

Toner 4 was obtained in the same manner as in Example 1 except that Vinyl Resin 1 was changed to Vinyl Resin 4. Evaluation was made on this Toner 4 in the same manner as in Example 1. Physical properties of the toner are shown in Tables 4 (A) and 4 (B), and the results of evaluation in Table 5.

Comparative Example 1

Resin B-5 vinyl resin having no carboxyl groups and Resin C-1 vinyl resin having epoxy groups were used in amounts of 90 parts by weight and 10 parts by weight, respectively, and these were mixed by means of a Henschel mixer. The mixture obtained was kneaded at 180° C. by means of a twin-screw extruder, followed by cooling and pulverization to obtain Vinyl Resin 5. The THF-insoluble matter of Vinyl Resin 5 obtained was in a content of 0%.

Toner 5 was obtained in the same manner as in Example 1 except that Vinyl Resin 1 was changed to Vinyl Resin 5. Evaluation was made on this Toner 5 in the same manner as in Example 1. Physical properties of the toner are shown in Tables 4 (A) and 4 (B), and the results of evaluation in Table 5.

Example 5

Resin B-6 vinyl resin having carboxyl groups and Resin C-2 vinyl resin having epoxy groups were used in amounts of 98 parts by weight and 2 parts by weight, respectively, and these were mixed by means of a Henschel mixer. The mixture obtained was kneaded at 200° C. by means of a twin-screw extruder to cause cross-linking reaction to take place, followed by cooling and pulverization to obtain Vinyl Resin 6. The THF-insoluble matter of Vinyl Resin 6 obtained was in a content of 15%.

Toner 6 was obtained in the same manner as in Example 1 except that Vinyl Resin 1 was changed to Vinyl Resin 6. Evaluation was made on this Toner 6 in the same manner as in Example 1. Physical properties of the toner are shown in Tables 4 (A) and 4 (B), and the results of evaluation in Table 5.

Example 6

Resin B-7 vinyl resin having carboxyl groups and Resin C-2 vinyl resin having epoxy groups were used in amounts of 90 parts by weight and 10 parts by weight, respectively, and these were mixed by means of a Henschel mixer. The mixture obtained was kneaded at 200° C. by means of a twin-screw extruder to cause cross-linking reaction to take place, followed by cooling and pulverization to obtain Vinyl Resin 7. The THF-insoluble matter of Vinyl Resin 7 obtained was in a content of 15%.

Toner 7 was obtained in the same manner as in Example 1 except that Vinyl Resin 1 was changed to Vinyl Resin 7. Evaluation was made on this Toner 7 in the same manner as in Example 1. Physical properties of the toner are shown in Tables 4 (A) and 4 (B), and the results of evaluation in Table 5.

Comparative Example 2

100 parts by weight of Resin B-1 vinyl resin having carboxyl groups was kneaded at 180° C. by means of a twin-screw extruder, followed by cooling and pulverization to obtain Vinyl Resin 8. The THF-insoluble matter of Vinyl Resin 8 obtained was in a content of 0%.

Toner 8 was obtained in the same manner as in Example 1 except that Vinyl Resin 1 was changed to Vinyl Resin 8. Evaluation was made on this Toner 8 in the same manner as in Example 1. Physical properties of the toner are shown in Tables 4 (A) and 4 (B), and the results of evaluation in Table 5.

Example 7

Toner 9 was obtained in the same manner as in Example 1 except that Copolymer D-1 was changed to Copolymer D-2. Evaluation was made on this Toner 9 in the same manner as in Example 1. Physical properties of the toner are shown in Tables 4 (A) and 4 (B), and the results of evaluation in Table 5.

Comparative Example 3

Toner 10 was obtained in the same manner as in Example 1 except that Copolymer D-1 was not added. Evaluation was made on this Toner 10 in the same manner as in Example 1. Physical properties of the toner are shown in Tables 4 (A) and 4 (B), and the results of evaluation in Table 5.

Example 8

| | |
|---|---|
| Vinyl Resin 1 | 80 parts |
| Copolymer D-1 | 20 parts |
| Magnetic iron oxide | 90 parts |
| Fischer-Tropsch wax | 2 parts |
| Paraffin wax | 4 parts |
| Monoazo iron complex | 2 parts |

The above materials were well premixed by means of a Henschel mixer. Thereafter, the mixture obtained was melt-kneaded by means of a twin-screw extruder set to 130° C. The kneaded product obtained was cooled, and then crushed using a cutter mill. Thereafter, the crushed product was finely pulverized by means of a fine grinding mill making use of jet streams. The resultant finely pulverized product was further classified by means of an air classifier to obtain a classified fine powder (toner particles) having a weight-average particle diameter of 6.7 μm.

To 100 parts by weight of the classified fine powder thus obtained, 1.2 parts by weight of hydrophobic fine silica powder (BET specific surface area: 200 $m^2/g$; obtained by treating a silica base material produced by the dry process, with dimethyldichlorosilane, thereafter treating it with hexamethylenedisilazane, and further treating it with dimethylsilicone oil) and 3.0 parts by weight of strontium titanate were added. These were mixed by means of a Henschel mixer, followed by sieving with a filter having a mesh size of 150 μm to obtain Toner 11. Physical properties of Toner 11 are shown in Tables 4 (A) and 4 (B).

Evaluation was also made on the resultant Toner 11 in the same manner as in Example 1. Physical properties of the toner are shown in Tables 4 (A) and 4 (B), and the results of evaluation in Table 5.

Comparative Example 4

Toner 12 was obtained in the same manner as in Example 1 except that Copolymer D-1 was changed to Copolymer D-3. Evaluation was made on this Toner 12 in the same manner as in Example 1. Physical properties of the toner are shown in Tables 4 (A) and 4 (B), and the results of evaluation in Table 5.

Example 8

Resin B-4 vinyl resin having carboxyl groups and Resin C-3 vinyl resin having epoxy groups were used in amounts of 95 parts by weight and 5 parts by weight, respectively, and these were mixed by means of a Henschel mixer. The mixture obtained was kneaded at 180° C. by means of a twin-screw extruder to cause cross-linking reaction to take place, followed by cooling and pulverization to obtain Vinyl Resin 9. The THF-insoluble matter of Vinyl Resin 9 obtained was in a content of 35%.

Toner 13 was obtained in the same manner as in Example 1 except that Vinyl Resin 1 was changed to Vinyl Resin 9. Evaluation was made on this Toner 13 in the same manner as in Example 1. Physical properties of the toner are shown in Tables 4 (A) and 4 (B), and the results of evaluation in Table 5.

TABLE 1

| | Resin No.: | | | | | | |
|---|---|---|---|---|---|---|---|
| | B-1 | B-2 | B-3 | B-4 | B-5 | B-6 | B-7 |
| Acid value (Av): (mg · KOH/g) | 10.8 | 0.9 | 5.5 | 47.6 | 0 | 52.3 | 1.6 |
| Glass transition point (Tg): (° C.) | 62.8 | 61.1 | 61.2 | 62.7 | 60.0 | 66.0 | 60.2 |
| Number-average molecular weight (Mn): | 7,000 | 7,000 | 7,000 | 7,000 | 8,000 | 7,000 | 8,000 |
| Weight-average molecular weight (Mw): | 150,000 | 150,000 | 150,000 | 150,000 | 200,000 | 150,000 | 200,000 |
| Peak molecular weight of low-molecular weight resin component ($Mp_L$): | 12,000 | 12,000 | 12,000 | 12,000 | 12,000 | 12,000 | 12,000 |
| Peak molecular weight of high-molecular weight resin component ($Mp_H$): | 300,000 | 300,000 | 300,000 | 300,000 | 300,000 | 300,000 | 300,000 |
| Epoxy value (eq/kg): | — | — | 0.02 | — | — | — | — |

TABLE 2

| | Resin No.: | | |
|---|---|---|---|
| | C-1 | C-2 | C-3 |
| Number-average molecular weight (Mn): | 6,000 | 6,000 | 4,000 |
| Weight-average molecular weight (Mw): | 15,000 | 15,000 | 30,000 |
| Main-peak molecular weight: | 12,000 | 12,000 | 10,000 |
| Epoxy value: (eq/kg) | 0.07 | 0.7 | 4.9 |

TABLE 3

| | Resin No.: | | |
|---|---|---|---|
| | D-1 | D-2 | D-3 |
| Number-average molecular weight (Mn): | 7,000 | 14,000 | 20,000 |
| Weight-average molecular weight (Mw): | 250,000 | 50,000 | 100,000 |
| Main-peak molecular weight: | 20,000 | 20,000 | 50,000 |
| THF-insoluble matter: (% by weight) | 3 | 2 | 55 |

TABLE 4 (A)

| | Example | | | | Comp. Example | Example | |
|---|---|---|---|---|---|---|---|
| | 1 | 2 | 3 | 4 | 1 | 5 | 6 |
| Toner No.: | 1 | 2 | 3 | 4 | 5 | 6 | 7 |
| Vinyl resin having carboxyl groups (B): | B-1 | B-2 | B-3 | B-4 | B-5*1 | B-6 | B-7 |
| Vinyl resin having epoxy groups (C): | C-1 | C-2 | C-1 | C-1 | C-1 | C-2 | C-2 |
| Resin mixing weight ratio B/C: | 95/5 | 90/10 | 95/5 | 95/5 | 90/10 | 98/2 | 90/10 |
| Aliphatic conjugated diene copolymer: | D-1 | D-1 | D-1 | D-1 | D-1 | D-1 | D-1 |
| Vinyl resin/diene copolymer: (weight ratio) | 80/20 | 80/20 | 80/20 | 80/20 | 80/20 | 80/20 | 80/20 |
| THF-insoluble matter of resin component of toner: (% by weight) | 30 | 25 | 25 | 35 | 0 | 45 | 25 |
| Diene compound/styrene*2: | 0.022 | 0.015 | 0.022 | 0.010 | 0 | 0.010 | 0.020 |
| Amount of diene copolymer in THF-insoluble matter: (% by weight) | 20.0 | 13.6 | 20.0 | 9.1 | 0 | 9.1 | 18.2 |
| Acid value (Av): (mg · KOH/g) | 8.6 | 0.6 | 4.2 | 38.0 | 0 | 51.2 | 0.8 |
| Number-average molecular weight (Mn): | 6,800 | 6,500 | 6,700 | 6,200 | 8,200 | 6,000 | 7,500 |
| Weight-average molecular weight (Mw): | 90,000 | 120,000 | 100,000 | 80,000 | 210,000 | 75,000 | 150,000 |
| Main-peak molecular weight: | 12,000 | 12,000 | 12,000 | 12,000 | 12,000 | 12,000 | 12,000 |
| Peak area of molecular weight of 30,000 or less: (%) | 78 | 80 | 80 | 82 | 59 | 85 | 62 |
| Glass transition point (Tg): (° C.) | 58 | 57 | 58 | 57 | 58 | 57 | 58 |
| DSC endothermic peak temperature: (° C.) | 80 | 80 | 80 | 80 | 80 | 80 | 80 |

TABLE 4(B)

| | Example | | | | | |
|---|---|---|---|---|---|---|
| | Comp. Example 2 | Example 7 | Comp. Example 3 | Example 8 | Comp. Example 4 | 9 |
| Toner No.: | 8 | 9 | 10 | 11 | 12 | 13 |
| Vinyl resin having carboxyl groups (B): | B-1 | B-1 | B-1 | B-1 | B-1 | B-4 |
| Vinyl resin having epoxy groups (C): | — | C-1 | C-1 | C-1 | C-1 | C-3 |
| Resin mixing weight ratio B/C: | 100/0 | 95/5 | 95/5 | 95/5 | 95/5 | 95/5 |
| Aliphatic conjugated diene copolymer: | D-1 | D-2 | — | D-1 | D-3 | D-1 |
| Vinyl resin/diene copolymer: (weight ratio) | 80/20 | 80/20 | 80/20 | 80/20 | 80/20 | 80/20 |
| THF-insoluble matter of resin component of toner: (% by weight) | 0 | 25 | 5 | 30 | 65 | 45 |
| Diene compound/styrene*2: | 0 | 0.022 | 0 | 0.022 | 0.005 | 0.020 |
| Amount of diene copolymer in THF-insoluble matter: (% by weight) | 0 | 20.0 | 0 | 20.0 | 4.5 | 1.8 |

TABLE 4(B)-continued

| | Example | | | | | |
|---|---|---|---|---|---|---|
| | Comp. Example 2 | Example 7 | Comp. Example 3 | Example 8 | Comp. Example 4 | 9 |
| Acid value (Av): (mg · KOH/g) | 8.8 | 8.6 | 9.8 | 8.6 | 8.5 | 32.3 |
| Number-average molecular weight (Mn): | 6,800 | 6,900 | 6,800 | 6,800 | 6,800 | 6,500 |
| Weight-average molecular weight (Mw): | 130,000 | 120,000 | 120,000 | 90,000 | 150,000 | 70,000 |
| Main-peak molecular weight: | 12,000 | 12,000 | 12,000 | 12,000 | 12,000 | 12,000 |
| Peak area of molecular weight of 30,000 or less: (%) | 73 | 76 | 74 | 78 | 75 | 75 |
| Glass transition point (Tg): (° C.) | 57 | 58 | 57 | 57 | 58 | 58 |
| DSC endothermic peak temperature: (° C.) | 80 | 80 | 80 | 80 | 80 | 80 |

*1: B-5 is a resin having no carboxyl group.

*2Proton integral value due to diene compound in $^{1}$H-NMR measurement/proton integral value due to styrene

TABLE 5

| | Example (Ex) | | | | Cp | Example | | Cp | Ex | Cp | Ex | Cp | Ex |
|---|---|---|---|---|---|---|---|---|---|---|---|---|---|
| | 1 | 2 | 3 | 4 | 1 | 5 | 6 | 2 | 7 | 3 | 8 | 4 | 9 |
| Toner No.: | 1 | 2 | 3 | 4 | 5 | 6 | 7 | 8 | 9 | 10 | 11 | 12 | 13 |
| Low-temperature fixing performance: (° C.) | 150 | 150 | 150 | 150 | 160 | 155 | 155 | 155 | 150 | 155 | 150 | 165 | 155 |
| Anti-offset properties: (° C.) | >240 | 240 | 240 | >240 | 190 | >240 | 240 | 190 | 240 | 190 | >240 | >240 | >240 |
| -N/N- Image density: | 1.42 | 1.41 | 1.40 | 1.35 | 1.21 | 1.28 | 1.25 | 1.43 | 1.41 | 1.41 | 1.41 | 1.22 | 1.30 |
| Fog: | 0.51 | 0.50 | 0.58 | 0.78 | 1.79 | 0.98 | 1.21 | 0.50 | 0.48 | 0.63 | 0.55 | 1.53 | 0.72 |
| Fixing separation claw contamination level: | A | A | A | A | C | A | A | C | A | C | A | B | B |
| -N/L- Image density: | 1.41 | 1.40 | 1.39 | 1.38 | 1.20 | 1.30 | 1.24 | 1.38 | 1.40 | 1.37 | 1.43 | 1.25 | 1.31 |
| Fog: | 0.58 | 0.55 | 0.60 | 1.21 | 2.83 | 1.56 | 1.63 | 0.53 | 0.62 | 0.78 | 0.52 | 1.98 | 1.21 |
| Fixing separation claw contamination level: | A | B | A | B | D | A | B | D | A | C | A | B | A |
| -H/H- Image density: | 1.38 | 1.40 | 1.38 | 1.21 | 1.01 | 1.05 | 1.18 | 1.35 | 1.35 | 1.28 | 1.39 | 1.02 | 1.11 |
| Fog: | 0.32 | 0.38 | 0.31 | 1.05 | 2.51 | 1.38 | 1.58 | 0.43 | 0.45 | 0.58 | 0.37 | 1.82 | 1.20 |
| Fixing separation claw contamination level: | A | B | A | B | D | A | B | D | A | C | A | B | B |

Cp: Comparative Example

What is claimed is:

1. A toner comprising toner particles having at least a binder resin and a colorant, wherein;

said binder resin in the toner contains at least i) a vinyl resin formed of a vinyl resin having at least a carboxyl group and a vinyl resin having at least an epoxy group, and having a cross-linked structure formed by the reaction of the carboxyl group of the former with the epoxy group of the latter, and ii) from 3 to 60% by weight of the binder resin of a copolymer having an aliphatic conjugated diene compound as a monomer component; and said binder resin in the toner has a THF-insoluble matter in a content of from 0.1% by weight to 60% by weight, and the copolymer having an aliphatic conjugated diene compound as a monomer component is incorporated in an o-dichlorobenzene-soluble matter of the THF-insoluble matter.

2. The toner according to claim 1, which has an acid value of from 0.1 mg.KOH/g to 50 mg.KOH/g.

3. The toner according to claim 1, which has, in molecular weight distribution measured by gel permeation chromatography of tetrahydrofuran-soluble matter in the toner, a main peak in the region of molecular weight of from 4,000 to 30,000.

4. The toner according to claim 1, wherein in a chart obtained by gel permeation chromatography measurement the peak area in the region of molecular weight of 30,000 or less is in a proportion of from 60% to 100% with respect to the total peak area.

5. The toner according to claim 1, wherein said copolymer having an aliphatic conjugated diene compound as a monomer component is a polymer obtained by copolymerizing styrene or a styrene derivative with an aliphatic conjugated diene compound.

6. The toner according to claim 5, wherein said copolymer having an aliphatic conjugated diene compound as a monomer component is a polymer obtained by copolymerizing styrene or a styrene derivative with an aliphatic conjugated diene compound in a proportion of a styrene or styrene derivative/aliphatic conjugated diene compound=65/35 to 98/2 in weight ratio.

7. The toner according to claim 1, which contains a wax in an amount of from 0.1 part by weight to 20 parts by weight based on 100 parts by weight of the binder resin.

8. The toner according to claim 1, which has, in the endothermic curve of the toner, measured with a differential scanning calorimeter a maximum peak in the regio9n of from 70° C. to 140° C.

9. The toner according to claim 1, where said colorant is a magnetic iron oxide.

10. The toner according to claim 9, wherein said magnetic iron oxide is contained in an amount of from 10 parts by weight to 200 parts by weight based on 100 parts by weight of the binder resin.

* * * * *

UNITED STATES PATENT AND TRADEMARK OFFICE

CERTIFICATE OF CORRECTION

PATENT NO. : 7,147,981 B2
APPLICATION NO. : 10/809458
DATED : December 12, 2006
INVENTOR(S) : Hiroyuki Fujikawa et al.

It is certified that error appears in the above-identified patent and that said Letters Patent is hereby corrected as shown below:

ON THE TITLE PAGE [56] REFERENCES CITED:

Foreign Patent Documents, after "JP 10-90943 4/1998" insert
--OTHER PUBLICATIONS
Patent Abstracts of Japan for JP01-145665, June 7, 1989--.

COLUMN 40:

Line 3, "regio9n" should read --region--.

Signed and Sealed this

Twenty-sixth Day of June, 2007

JON W. DUDAS
*Director of the United States Patent and Trademark Office*